US009860642B2

(12) United States Patent
Rin et al.

(10) Patent No.: US 9,860,642 B2
(45) Date of Patent: Jan. 2, 2018

(54) AUDIO WIRELESS TRANSMISSION SYSTEM, SPEAKER DEVICE, AND SOURCE DEVICE

(71) Applicant: Sharp Kabushiki Kaisha, Osaka-shi, Osaka (JP)

(72) Inventors: Yasuhiro Rin, Osaka (JP); Mamoru Oda, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 0 days.

(21) Appl. No.: 15/101,544

(22) PCT Filed: Dec. 1, 2014

(86) PCT No.: PCT/JP2014/081692
§ 371 (c)(1),
(2) Date: Jun. 3, 2016

(87) PCT Pub. No.: WO2015/083653
PCT Pub. Date: Jun. 11, 2015

(65) Prior Publication Data

US 2017/0013359 A1 Jan. 12, 2017

(30) Foreign Application Priority Data

Dec. 6, 2013 (JP) ..... 2013-253233

(51) Int. Cl.
*H04R 29/00* (2006.01)
*H04R 3/12* (2006.01)

(52) U.S. Cl.
CPC ..... *H04R 3/12* (2013.01); *H04R 29/001* (2013.01); *H04R 29/002* (2013.01); *H04R 2420/07* (2013.01)

(58) Field of Classification Search
CPC ..... H04R 3/12; H04R 29/001; H04R 29/002; H04R 2420/07
See application file for complete search history.

(56) References Cited

U.S. PATENT DOCUMENTS 6,671,520 B1 * 12/2003 Kim ..... G08C 17/02 348/14.02
2002/0071568 A1 * 6/2002 Shuttleworth ..... H04R 29/001 381/58

(Continued)

FOREIGN PATENT DOCUMENTS

JP 2004-328692 A 11/2004

*Primary Examiner* — Sonia Gay
(74) *Attorney, Agent, or Firm* — Keating & Bennett, LLP

(57) ABSTRACT

In a one-to-many audio wireless transmission system in which a plurality of speaker devices on an audio reception side are provided with respect to one source device, in a case where an error has occurred in a certain speaker device, a possibility of the same error occurring in other speaker devices is reduced. A speaker device (2*a*, 2*b*) includes an error detection unit (23) which detects an error regarding sound output and transmits error information which is information regarding an error detected by the error detection unit (23) to a source device (1) by using wireless communication. The source device (1) transmits an operation request corresponding to the error information by using wireless communication to speaker devices other than the speaker device which has transmitted the error information.

10 Claims, 13 Drawing Sheets

(56) References Cited

U.S. PATENT DOCUMENTS

| | | | | |
|---|---|---|---|---|
| 2005/0190928 | A1* | 9/2005 | Noto | H04R 3/12 381/77 |
| 2008/0144862 | A1* | 6/2008 | Xu | H03F 3/217 381/120 |
| 2008/0167827 | A1* | 7/2008 | McAllister | G01R 31/025 702/59 |
| 2010/0188212 | A1* | 7/2010 | Jochelson | H04R 5/04 340/540 |
| 2014/0365832 | A1* | 12/2014 | Neeb | G06F 13/1673 714/43 |

* cited by examiner

FIG.5A

81

| | Length | Description |
|---|---|---|
| Device Type | 1Byte | TYPE OF DEVICE IN RECEPTION DEVICE |
| Status | 1Byte | DEVICE STATE |

FIG.5B

82

| Value | Type | Description |
|---|---|---|
| 0x00 | CPU | MAIN CONTROL UNIT |
| 0x01 | RX | WIRELESS COMMUNICATION UNIT (RECEPTION UNIT) |
| 0x02 | VOL | VOLUME ADJUSTMENT UNIT |
| 0x03 | DAC | DAC |
| 0x04 | AMP | AMP |
| 0x05 | APOW | ANALOG POWER SOURCE |
| 0x06 | DPOW | DIGITAL POWER SOURCE |
| ... | ... | ... |

FIG.5C

83

| Value | Status | Description |
|---|---|---|
| 0x00 | OK | NORMAL |
| 0x01 | OVC | OVERCURRENT (WARNING) |
| 0x02 | LVOL | REDUCED VOLTAGE (WARNING) |
| 0x03 | OVT | OVERTEMPERATURE (WARNING) |
| 0x04 | ILV | ABNORMAL VOLTAGE (WARNING) |
| 0x05 | OFST | CURRENT OFFSET (WARNING) |
| 0x06 | ILCK | CLOCK ABNORMALITY (WARNING) |
| 0x07 | STCK | CLOCK STOP (WARNING) |
| 0x08 | SYSERR | SYSTEM ABNORMALITY (WARNING) |
| ... | ... | ... |
| 0x10 | OK | |
| 0x11 | OVC | OVERCURRENT (FATAL) |
| 0x12 | LVOL | REDUCED VOLTAGE (FATAL) |
| 0x13 | OVT | OVERTEMPERATURE (FATAL) |
| 0x14 | ILV | ABNORMAL VOLTAGE (FATAL) |
| 0x15 | OFST | CURRENT OFFSET (FATAL) |
| 0x16 | ILCK | CLOCK ABNORMALITY (FATAL) |
| 0x17 | STCK | CLOCK STOP (FATAL) |
| 0x18 | SYSERR | SYSTEM ABNORMALITY (FATAL) |
| ... | ... | ... |

FIG.6A

91

| | Length | Description |
|---|---|---|
| Device Type | 1Byte | TYPE OF DEVICE IN RECEPTION DEVICE |
| Command | 1Byte | COMMAND |
| Parameter | 2Byte | COMMAND PARAMETER |

FIG.6B

92

| Value | Type | Description |
|---|---|---|
| 0x00 | CPU | MAIN CONTROL UNIT |
| 0x01 | RX | WIRELESS COMMUNICATION UNIT (RECEPTION UNIT) |
| 0x02 | VOL | VOLUME ADJUSTMENT UNIT |
| 0x03 | DAC | DAC |
| 0x04 | AMP | AMP |
| ... | ... | ... |

FIG.6C

93

| Value | Command | Description |
|---|---|---|
| 0x00 | RESUME | RETURN |
| 0x01 | PSTOP | POWER SUPPLY STOP |
| 0x02 | VOL | VOLUME ADJUSTMENT (SET VOLUME VALUE IN PARAMETER) |
| 0x03 | RESET | RESET |
| 0x04 | TEMP | TEMPERATURE MEASUREMENT |
| 0x05 | VOLT | VOLTAGE MEASUREMENT |
| 0x06 | CLK | CLOCK MEASUREMENT |
| ... | ... | ... |

FIG.7A

101

| ERROR RELEVANT INFORMATION | Length | Description |
|---|---|---|
| Device Type | 1Byte | TYPE OF DEVICE IN RECEPTION DEVICE |
| Status | 1Byte | DEVICE STATE |
| Parameter | 2Byte | PARAMETER |

FIG.7B

102

| Value | Device Type | Description |
|---|---|---|
| 0x00 | CPU | MAIN CONTROL UNIT |
| 0x01 | RX | WIRELESS COMMUNICATION UNIT (RECEPTION UNIT) |
| 0x02 | VOL | VOLUME ADJUSTMENT UNIT |
| 0x03 | DAC | DAC |
| 0x04 | AMP | AMP |
| ... | ... | ... |

FIG.7C

103

| Value | Status | Description |
|---|---|---|
| 0x00 | RESUME | RETURN COMPLETED |
| 0x01 | PSTOP | POWER SUPPLY STOP COMPLETED |
| 0x02 | VOL | CURRENT VOLUME ACQUISITION COMPLETED |
| 0x03 | RESET | RESET COMPLETED |
| 0x04 | TEMP | TEMPERATURE MEASUREMENT COMPLETED |
| 0x05 | VOLT | VOLTAGE MEASUREMENT COMPLETED |
| 0x06 | CLK | CLOCK MEASUREMENT COMPLETED |
| ... | ... | ... |
| 0x10 | RESUME | RETURN IN PROGRESS |
| 0x11 | PSTOP | POWER SUPPLY STOP IN PROGRESS |
| 0x12 | VOL | CURRENT VOLUME ACQUISITION IN PROGRESS |
| 0x13 | RESET | RESET IN PROGRESS |
| 0x14 | TEMP | TEMPERATURE MEASUREMENT IN PROGRESS |
| 0x15 | VOLT | VOLTAGE MEASUREMENT IN PROGRESS |
| 0x16 | CLK | CLOCK MEASUREMENT IN PROGRESS |
| ... | ... | ... |

AUDIO WIRELESS TRANSMISSION SYSTEM, SPEAKER DEVICE, AND SOURCE DEVICE

TECHNICAL FIELD

The present invention relates to an audio wireless transmission system which transmits an audio signal by radio, a speaker device and a source device of the system.

BACKGROUND ART

In recent years, the number of devices operating using wireless communication has been increased in audio visual (AV) devices and wireless transmission of sound is performed by using WiFi (registered trademark, the same applies hereinafter), ZigBee (registered trademark, the same applies hereinafter), and Bluetooth (registered trademark, the same applies hereinafter). However, compressed sound is a subject of current audio wireless transmission.

Since compressed sound is a subject of current audio wireless transmission as described above, it is not yet necessary to perform evaluation of sound quality. However, when audio devices are connected by radio, usability is improved, and therefore, the realization of wireless communication is also promoted for high-level audio devices requiring high sound quality. For example, Wireless Speaker and Audio (WiSA) Association has proceeded with standardization of technologies of wirelessly transmitting audio signals by decompressed pulse code modulation (PCM).

Meanwhile, particularly in high-level audio devices, large electric power is consumed due to high wattage or the like, and accordingly, the audio devices may be seriously damaged or broken due to a minute flaw. Thus, an overcurrent countermeasure is necessary particularly for high-level audio devices.

PTL 1, for example, discloses a technology for an overcurrent countermeasure of an audio wireless transmission system. In the technology disclosed in PTL 1, a device on an audio reception side includes a power amplifier which amplifies electric power, and a power source circuit in which a small cell for power amplifier driving and an electric double layer capacitor are arranged in parallel, and accordingly, a long-term operation can be performed even with a small cell and an overcurrent due to a rapid change of audio signals can be controlled.

CITATION LIST

Patent Literature

PTL 1: Japanese Unexamined Patent Application Publication No. 2004-328692

SUMMARY OF INVENTION

Technical Problem

However, in the technology disclosed in PTL 1, there is no disclosure about a one-to-many audio wireless transmission system in which a plurality of speaker devices on an audio reception side are provided with respect to one source device, and when the technology disclosed in PTL 1 is applied to such a system, the speaker device can only control an overcurrent occurring in the speaker device. With respect to this, in such a one-to-many audio wireless transmission system, errors such as an overcurrent which occurs in a certain speaker device may occur in other speaker devices. For example, in a case where a temperature of one speaker device becomes equal to or higher than a prescribed temperature, a temperature of other speakers may also become equal to or higher than a prescribed temperature due to an influence of an environmental temperature. In a case where a voltage applied to one speaker device is reduced, other speaker devices having an AC power source supplied from the same electrical outlet may have the same error. In such a case, other speaker devices may also be damaged.

The invention is made in view of such circumstances as described above, and an object of the invention is, in a case where an error has occurred in a certain speaker device, to reduce a possibility of the same error occurring in other speaker devices, in a one-to-many audio wireless transmission system in which a plurality of speaker devices on an audio reception side are provided with respect to one source device.

Solution to Problem

In order to solve the above-mentioned problems, according to a first aspect of the invention, there is provided an audio wireless transmission system including: a plurality of speaker devices; and a source device which transmits an audio signal to the plurality of speaker devices by using wireless communication, in which the speaker device includes an error detection unit which detects an error regarding audio output and transmits error information which is information regarding an error detected by the error detection unit to the source device by using wireless communication, and the source device transmits an operation request corresponding to the error information by using wireless communication to speaker devices other than the speaker device which has transmitted the error information.

According to a second aspect of the invention, in the audio wireless transmission system according to the first aspect, the speaker device includes an analog power source unit which supplies electric power to an analog circuit, a digital power source unit which supplies electric power to a digital circuit, a wireless reception unit which receives the audio signal, a control unit, a D/A converter which converts the audio signal received by the wireless reception unit into an analog signal from the digital signal, an amplification unit which amplifies the analog signal output from the D/A converter, and a speaker unit which outputs sound of the analog signal output from the amplification unit.

According to a third aspect of the invention, in the audio wireless transmission system according to the second aspect, the error detection unit executes a detection process of errors with respect to at least one unit of the analog power source unit, the digital power source unit, the wireless reception unit, the control unit, the D/A converter, the amplification unit, and the speaker unit.

According to a fourth aspect of the invention, in the audio wireless transmission system according to the second or third aspect, the amplification unit and the speaker unit are provided in the same housing as or a separate housing from the wireless reception unit.

According to a fifth aspect of the invention, in the audio wireless transmission system according to any one of the first to fourth aspects, the error information includes information indicating at least one of an overcurrent warning, a voltage drop warning, an overtemperature warning, a voltage abnormality warning, a current offset warning, a clock abnormality warning, a clock stop warning, and a system abnormality warning.

According to a sixth aspect of the invention, in the audio wireless transmission system according to any one of the first to fifth aspects, the source device instructs the speaker device which has transmitted the error information to some or all of the plurality of speaker devices to measure and detect error relevant information which is information related to an error indicated by the received error information.

According to a seventh aspect of the invention, in the audio wireless transmission system according to the sixth aspect, the error relevant information includes at least one of information of a temperature measurement value, a voltage measurement value, a clock measurement value, and presence or absence of a clock operation.

According to an eighth aspect of the invention, in the audio wireless transmission system according to any one of the first to seventh aspects, the source device further includes a display unit which displays information indicating the occurrence of an error, in a case where the error information is received.

According to a ninth aspect of the invention, there is provided a speaker device including: a wireless reception unit which receives an audio signal transmitted from a source device by using wireless communication, in which the speaker device includes an error detection unit which detects an error regarding sound output and transmits error information which is information regarding an error detected by the error detection unit to the source device by using wireless communication, and receives an operation request corresponding to the error information which is transmitted by using wireless communication by the source device which has received the error information from another speaker device capable of transmitting the error information by using wireless communication, by using wireless communication.

According to a tenth aspect of the invention, there is provided a source device which transmits an audio signal to a plurality of speaker devices by using wireless communication, in which the speaker device includes an error detection unit which detects an error regarding sound output and transmits error information which is information regarding an error detected by the error detection unit to the source device by using wireless communication, and the source device transmits an operation request corresponding to the error information by using wireless communication to speaker devices other than the speaker device which has transmitted the error information.

Advantageous Effects of Invention

According to the present invention, in a one-to-many audio wireless transmission system in which a plurality of speaker devices on an audio reception side are provided with respect to one source device, it is possible, in a case where an error has occurred in a certain speaker device, to reduce a possibility of the same error occurring in other speaker devices, and it is possible to prevent the same error from occurring in advance, in some cases.

BRIEF DESCRIPTION OF DRAWINGS

FIG. 5A is a diagram showing an example of reception parameters received by a source device side from a speaker device side in the audio wireless transmission system according to First Embodiment of the invention.

FIG. 5B is a diagram showing an example of Device Type among the reception parameters of FIG. 5A.

FIG. 5C is a diagram showing an example of Status among the reception parameters of FIG. 5A.

FIG. 6A is a diagram showing an example of transmission parameters transmitted from the source device side to the speaker device side in the audio wireless transmission system according to First Embodiment of the invention.

FIG. 6B is a diagram showing an example of Device Type among the transmission parameters of FIG. 6A.

FIG. 6C is a diagram showing an example of Command among the transmission parameters of FIG. 6A.

FIG. 7A is a diagram showing an example of response parameters transmitted from the speaker device side to the source device side in the audio wireless transmission system according to First Embodiment of the invention.

FIG. 7B is a diagram showing an example of Device Type among the response parameters of FIG. 7A.

FIG. 7C is a diagram showing an example of Status among the response parameters of FIG. 7A.

DESCRIPTION OF EMBODIMENTS

An audio wireless transmission system according to the invention is a system including a source device and a plurality of speaker devices and is also referred to as a wireless audio system or a wireless speaker system. Examples of the source device include various audio reproduction devices such as a compact disc (CD) player, a super audio CD (SACD) player, a Blu-ray disc (BD; registered trademark) player, and a hard disk drive (HDD) player, a television device, and a personal computer (PC). Herein, as an audio reproduction device, a network player which receives a music file stored in a server on a network through a network and transmits the music file to a speaker device by radio is used. In addition, some parts of a speaker device may be embedded in any source device (the embedded speaker device may have a configuration of performing various data transmission in a wired manner). For example, a center speaker is prepared in a housing of a display unit in a television device and a speaker for another channel can be disposed in another housing as the speaker device. Hereinafter, an audio wireless transmission system according to the invention will be described with reference to the drawings.

First Embodiment

Figure 1:
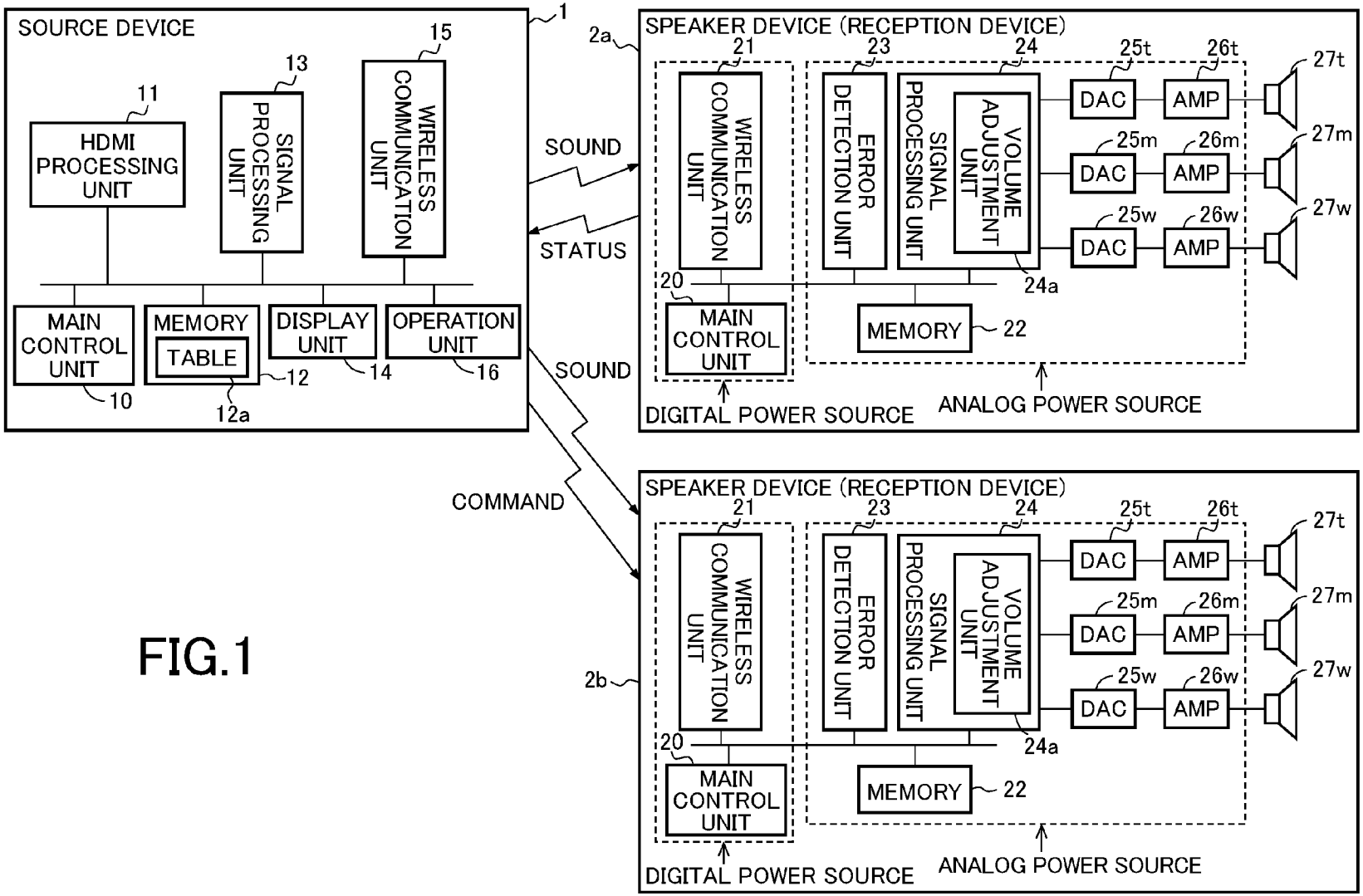
FIG. 1 is a block diagram showing a configuration example of an audio wireless transmission system according to First Embodiment of the invention.

FIG. 1 is a block diagram showing a configuration example of an audio wireless transmission system according to First Embodiment of the invention.

The audio wireless transmission system shown in FIG. 1 includes a source device 1 which is a source of an audio signal, and speaker devices 2*a* and 2*b* which are on a reception device side (reproduction side) of an audio signal.

The audio wireless transmission system of this configuration example will be described by assuming that two speaker devices 2*a* and 2*b* disposed for each channel are included, the speaker device 2*a* reproduces an audio signal of a left channel (Lch), and the speaker device 2*b* reproduces an audio signal of a right channel (Rch).

However, the number of speaker devices is not limited thereto and the same configuration can be applied, even when the number of speaker devices is three or more, as long as a source device and speaker devices are provided in a one-to-many relationship. For example, six speaker devices can also be included in an audio wireless transmission system for reproduction of 5.1 ch.

The source device 1 includes a control unit (referred to as a main control unit) 10 which controls the entire device through a bus and a wireless communication unit 15. The main control unit 10 is, for example, configured with a central processing unit (CPU). By including the wireless communication unit 15, the source device 1 can function as a wireless transmission device which transmits an uncompressed audio signal (audio signal maintained as an original sound) to the speaker devices 2*a* and 2*b* by using wireless communication.

The source device 1 of this configuration example includes a high-definition multimedia interface (HDMI; registered trademark, the same applies hereinafter) processing unit 11, an HDMI input unit and an HDMI output unit (not shown) which are connected to the HDMI processing unit 11. The source device 1 includes a signal processing unit 13 which performs a prescribed signal process with respect to an audio signal output from the HDMI processing unit 11. As a prescribed signal process performed by the signal processing unit 13, a correction process of correcting an audio signal of each channel before transmitting the audio signal, for example, a process of changing sound quality according to a user operation, is used. The signal process performed by the signal processing unit 13 is a process different from a prescribed signal process performed by a signal processing unit 24 which will be described later.

The HDMI processing unit 11 extracts audio signals from a signal input by the HDMI input signal and transmits the audio signals to the signal processing unit 13, and the signal processing unit 13 or the main control unit 10 instructs the wireless communication unit 15 to perform wireless communication of the signal-processed audio signals (audio signal of Lch and the audio signal of Rch). The audio signal of Lch and the audio signal of Rch which are transmitted by radio are respectively received and extracted by wireless communication units 21 of the speaker devices 2*a* and 2*b* and output to signal processing units 24 which will be described later.

The embodiment is described by assuming that audio signals are HDMI-input in the source device 1, but there is no limitation. The audio signals may be input by using other input modules, or audio signals stored in a storage unit separately provided in the source device 1 can be read and transmitted to the signal processing unit 13.

The source device 1 of this configuration example includes a memory 12 which will be described later, a display unit 14 which displays various information items, and an operation unit 16 which receives a user operation and transmits an operation signal thereof to the main control unit 10. As the operation unit 16, a reception unit which receives a signal such as an infrared signal from buttons provided on a main body of the source device 1 and a remote controller, main body buttons, a reception unit which receives a control signal from a terminal device such as a tablet, smart phone, or a personal digital assistant by using wireless communication, and the like are used.

The main control unit 10 superimposes a control signal corresponding to an operation signal on a radio carrier wave by using the wireless communication unit 15 and transmits the superimposed signal to the speaker devices 2*a* and 2*b* side, and accordingly, it is possible to control the speaker devices 2*a* and 2*b* from the source device 1 side.

Meanwhile, both speaker devices 2*a* and 2*b* include control units (referred to as main control units) 20 which control the entire device through a bus and wireless communication units 21, and a power source with lower electric power compared to a power source supplied to other parts is supplied to the main control units 20 and the wireless communication units 21. Both of the exemplified speaker devices 2*a* and 2*b* include a digital power source unit which supplies electric power to a digital circuit such as a digital signal processing circuit as the power source with lower electric power, and includes an analog power source unit which supplies electric power to an analog circuit such as an analog signal processing circuit as the power source supplied to other parts.

The main control unit 20 is an example of a control unit which controls D/A converters (DACs) 25*t*, 25*m*, and 25*w* and amplification units 26*t*, 26*m*, and 26*w* which will be described later and is, for example, configured with a CPU or the like. By including the wireless communication units 21, the speaker devices 2*a* and 2*b* can function as a wireless reception device which receives an audio signal transmitted from the source device 1 by using wireless communication. The wireless communication units 21 are an example of a wireless reception unit which receives an audio signal.

Modules on a transmission side and a reception side which are promoted to be standardized by WiSA Association can be respectively applied as the wireless communication unit 15 and the wireless communication units 21. The configuration for performing a process (an error process which will be described later) according to the embodiment is described as an example in which audio signals are transmitted by radio in an uncompressed manner since it is preferable to mount the configuration on higher-class audio devices in terms of detecting and controlling more minute errors, but there is no limitation, and compressed audio signals may also be a target of wireless transmission.

Both of the speaker devices 2*a* and 2*b* include the DACs 25*t*, 25*m*, and 25*w* which convert audio signals received from the source device 1 by using wireless communication into analog signals from digital signals, and speaker units 27*t*, 27*m*, and 27*w* which output sounds of the analog signals output from the DACs 25*t*, 25*m*, and 25*w*.

The speaker units 27*t*, 27*m*, and 27*w* and the DACs 25*t*, 25*m*, and 25*w* correspond to each other in a one-on-one manner, and the speaker units 27*t*, 27*m*, and 27*w* respectively output sounds of the analog signals output from the DACs 25*t*, 25*m*, and 25*w*. Herein, the speaker units 27*t*, 27*m*, and 27*w* respectively indicate speakers such as a tweeter, a midrange, and a woofer, but the number or combination of the speaker units is not limited thereto.

Both of the speaker devices 2*a* and 2*b* further include signal processing units 24 which execute a prescribed process with respect to the audio signals received by the wireless communication units 21 and output the signals to the DACs 25*t*, 25*m*, and 25*w*, and the amplification units (AMPs) 26*t*, 26*m*, and 26*w* which amplify the audio signals converted by the DACs 25*t*, 25*m*, and 25*w* and respectively output the audio signals to the speaker units 27*t*, 27*m*, and 27*w*.

The signal processing units 24 output different audio signals (audio signals to be output by the speaker units 27*t*, 27*m*, and 27*w* through the amplification units 26*t*, 26*m*, and 26*w*, respectively) to the DACs 25*t*, 25*m*, and 25*w*, respectively, and the DACs 25*t*, 25*m*, and 25*w* convert the audio signals processed by the signal processing units 24 from digital signals into analog signals.

The signal processing units 24 include volume adjustment units 24*a* which adjust the volume of the sounds to be respectively output from the speaker units 27*t*, 27*m*, and 27*w*, by adjusting the amplification units 26*t*, 26*m*, and 26*w*. Various filter processes, for example, are used in addition to such a volume adjustment process, as the prescribed signal process performed by the signal processing units 24. The parameters necessary for these processes are stored in memories 22, read out, if necessary, and rewritten based on control signals according to the operation signals.

As the main characteristics of the embodiment, both of the speaker devices 2*a* and 2*b* include error detection units 23 which detect errors regarding sound output, and error information which is information regarding errors detected by the error detection units 23 is transmitted to the source device 1 by using wireless communication. In the configuration example described herein, the error detection units 23 may execute a detection process of errors with respect to at least one unit of the analog power source unit, the digital power source unit, the wireless communication unit 21, the main control unit 20, the DACs 25*t*, 25*m*, and 25*w*, the amplification units 26*t*, 26*m*, and 26*w*, and the speaker units 27*t*, 27*m*, and 27*w*. For example, the error detection units 23 may also be constituted so as to execute a detection process of errors of the DACs 25*t*, 25*m*, and 25*w* and/or the amplification units 26*t*, 26*m*, and 26*w*.

When the embodiment is described by assuming a case where errors have occurred in the speaker device 2*a*, the main control unit 20 of the speaker device 2*a* receives error detection from the error detection unit 23 and transmits error information which is information regarding the detected errors to the source device 1 through the wireless communication unit 21. The information may be transmitted only at the time of detecting the errors or information indicating states of errors (status information) may be regularly transmitted.

For convenience of description, in this configuration example and other configurations which will be described later, the error detection unit is shown in the drawings and described so as to be provided as a part commonly used for the DAC, the signal processing unit, the amplification unit, and the main control unit, but there is no limitation to such a configuration. In practice, the error detection unit may be provided for each constituent element, by providing the error detection unit for DACs 25*t* in the DACs 25*t*, for example. The main control unit 20 controls the signal processing unit 24, the DACs 25*t* and the like, the amplification units 26*t* and the like, and the digital power source unit or the analog power source unit, and may be configured so as to receive error information items from each unit, when errors occur, as feedback information to the control described above. The main control unit 20 may have a part of a detection function of the error detection unit 23.

When the error information is received, the source device 1 transmits an operation request corresponding to the error information by using wireless communication to the speaker device 2*b* other than the speaker device 2*a* which has transmitted the error information. More specifically, the main control unit 10 may transmit a signal indicating an operation request as one type of a control signal for controlling the other speaker device 2*b* from the wireless communication unit 15. The main control unit 20 of the speaker device 2*b* receiving this signal executes a process corresponding to the operation request. That is, the speaker device 2*b* receives an "operation request corresponding to the error information" which is transmitted by using wireless communication by the source device 1 which has received the error information from the other speaker device 2*a* capable of transmitting the error information by using wireless communication, by using wireless communication, and executes a process corresponding to the operation request.

By performing the error process described above, in a case where an error has occurred in a certain speaker device, it is possible to rapidly reduce a possibility of the same error occurring in other speaker devices by the control from the source device side, and it is possible to prevent the same error from occurring in advance, in some cases (in a case where the error has not yet occurred in the other speaker devices).

For example, it is possible to further avoid the occurrence of errors in the other speaker device 2*b*, by employing an operation stop request to the speaker device 2*b*, as the operation request. In addition, in a case where errors have occurred in any of the DACs 25*t*, 25*m*, and 25*w* of the speaker device 2*a*, an operation stop request to the corresponding DAC among the DACs 25*t*, 25*m*, and 25*w* of the speaker device 2*b*, or an operation stop request to all of the three DACs 25*t*, 25*m*, and 25*w* may be transmitted from the source device 1 to the speaker device 2*b*.

The speaker device 2*b* stops the operation of the DACs by blocking the power supplied to the corresponding DAC (the speaker device may block the power supply to all parts to which electric power is supplied from the analog power source) in accordance with the operation stop request.

In addition, the same control signal may also be transmitted to the speaker device 2*a* which has transmitted the error information. However, since the speaker device 2*a* is basically in a state where the error has occurred, the speaker device has a function of performing the process with respect to the error (operation stop process or the like) by itself in advance, and damage can be further reduced by executing the process.

Herein, the embodiment will be described by assuming that the error information is transmitted by the wireless communication unit 21 and received by the wireless communication unit 15 and the operation request signal is transmitted by the wireless communication unit 15 and received by the wireless communication unit 21. Meanwhile, separate wireless communication units may be provided in the speaker devices 2*a* and 2*b* for the transmission of the error information or the reception of the operation request signal or separate wireless communication unit may be provided in the source device 1 for reception of the error information or the transmission of the operation request signal. The standardized wireless communication units such as WiFi, ZigBee, or Bluetooth described above can also be used as the separately provided wireless communication units for transmitting and receiving the error information or the operation request signal corresponding thereto.

In the embodiment where the amplification units 26*t*, 26*m*, and 26*w* are provided as in this configuration example, it is preferable that the error detection unit 23 performs both of the detection process of errors of the DACs 25*t*, 25*m*, and 25*w* and the detection process of errors of the amplification units 26*t*, 26*m*, and 26*w*. In a case where the plurality of sets of the speaker unit, the amplification unit, and the DAC are provided as in this configuration example, the detection process of errors for each of speaker units, amplification units, and DACs may be performed. As the operation request for the speaker device 2*b* transmitted from the source device 1, an operation stop request containing at least a part of the speaker device 2*a* where the error is detected is used, for example, and a mute request for the speaker units or the amplification units can also be applied depending on the error. Accordingly, it is also possible to cope with both errors, not only any one of the errors of the DAC and the amplification unit.

In the embodiment where the signal processing unit 24 is provided as in this configuration example, it is preferable that the error detection unit 23 performs the detection process of errors of the signal processing unit 24, in addition to the detection process of errors of the DACs 25*t*, 25*m*, and 25*w*. Even in this case, as the operation request for the speaker device 2*b* transmitted from the source device 1, an operation stop request containing at least a part of the speaker device 2*a* where the error is detected is used, for example, and a mute request for the speaker units or the amplification units can also be applied depending on the error. Accordingly, it is also possible to cope with the errors of the signal processing unit, not only the errors of the DAC or the amplification unit.

It is preferable that a table 12*a* where the operation requests (operation request signals) to be transmitted in accordance with the error information are described is stored in the memory 12 embedded in the source device 1. Accordingly, the main control unit 10 only needs to refer to the table 12*a*, and thus, an operation request signal can immediately transmit to the other speaker device at the time of the occurrence of errors.

In addition, it is preferable that the main control unit 10 of the source device 1 controls the display unit 14 to display information indicating that the error has occurred, in a case where the error information is received. Accordingly, not only is a process of immediately stopping the operation of the entire system on the reception side due to the error occurring in one speaker device possible, but it is also possible to immediately inform a user of the content of the error.

In the embodiment where the main control unit 20 is provided as in this configuration example, it is preferable that the error detection unit 23 performs the detection process of errors (internal errors) of the main control unit 20, in addition to the detection process of errors of the DACs 25*t*, 25*m*, and 25*w* and/or the amplification units 26*t*, 26*m*, and 26*w*. In this case also, as the operation request for the speaker device 2*b* transmitted from the source device 1, an operation stop request containing at least a part of the speaker device 2*a* where the error is detected is used, for example, and a stop request for the main control unit 20 can also be applied depending on the error. Accordingly, it is also possible to cope with the errors of the control unit which controls the DACs or the amplification units, not only the errors of the DACs or the amplification units. Furthermore, it is also possible to cope with the errors of the signal processing unit 24, not only the errors of the main control unit 20.

Hereinabove, in the configuration example of FIG. 1, the amplification units and the speaker units are provided in the same housing as that of the wireless communication unit 21. More specifically, the plurality of DACs (DAC 25*t* and the like) or the amplification units and the speaker units corresponding thereto are provided in each of the speaker devices 2*a* and 2*b*, and the speaker units (speaker unit 27*t* and the like) are provided in the same housing as that of the DACs 25*t*, 25*m*, and 25*w*. In a case where the speaker units are provided in the same housing as that of the DACs, the signal processing unit 24 which is provided between the amplification units or the DACs provided in a fore stage of the speaker units and the wireless communication unit 21, and the wireless communication unit 21 are also provided in the same housing as that of the speaker units.

In the example in which the above-mentioned units are provided in the same housing as described above, the system is configured to output aligned sounds so that the speaker units and the DACs or the amplification units are not damaged, in a case where the system is distributed as a product, and therefore, it is also possible to output high-quality sounds as an audio wireless transmission system.

The audio wireless transmission system according to the invention is not limited to the configuration example of FIG. 1. For example, one set of the DAC and the amplification unit and the speaker unit corresponding thereto may be respectively provided in the speaker devices 2*a* and 2*b*. Therefore, it is possible cope with various arrangement relations.

Other configuration examples will be described with reference to FIG. 2 to FIG. 4. In each configuration example hereinafter, only the points different from the configuration example of FIG. 1 will be described.

Figure 2:
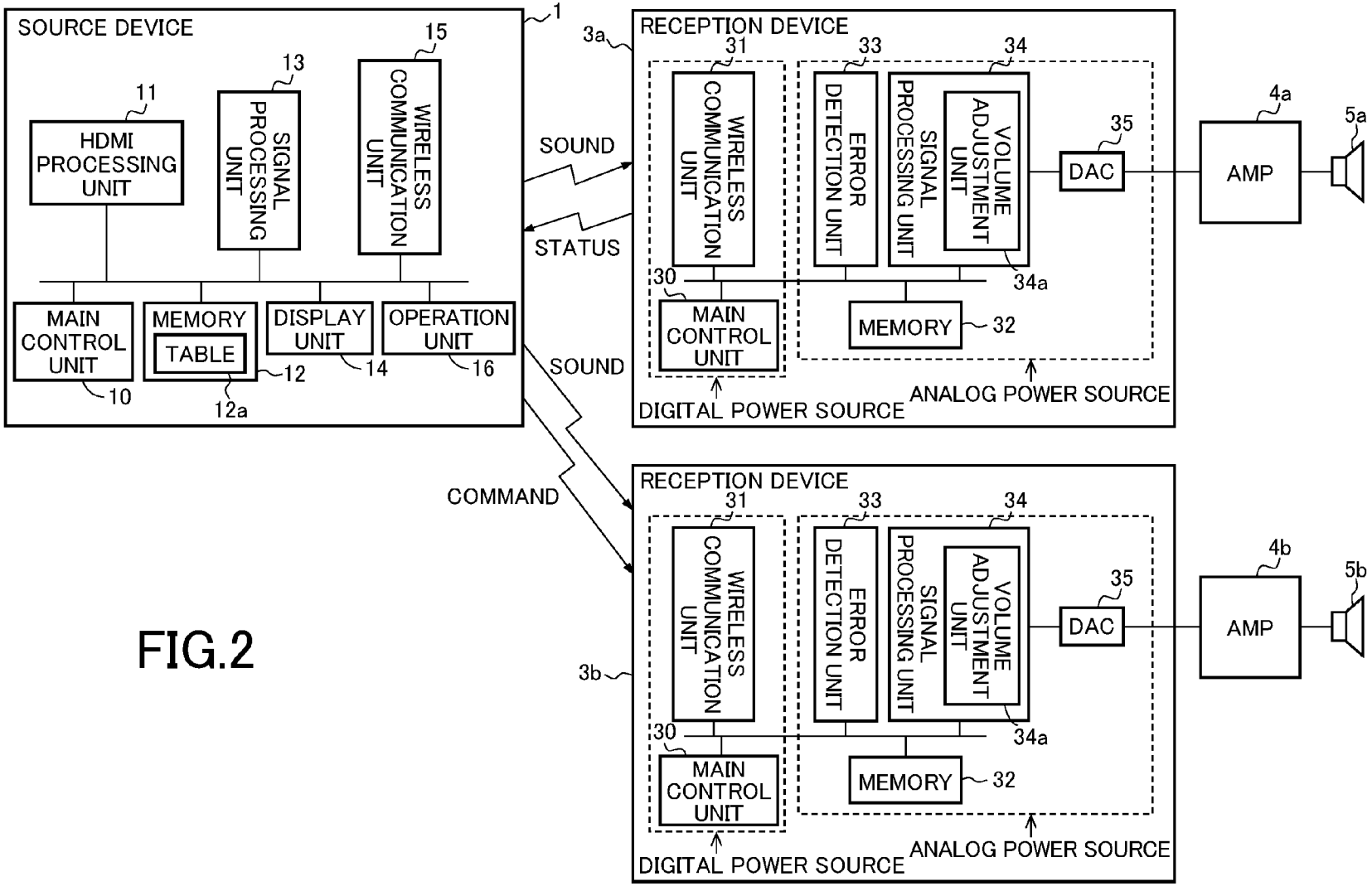
FIG. 2 is a block diagram showing another configuration example of the audio wireless transmission system according to First Embodiment of the invention.

In the configuration example shown in FIG. 2, a reception device 3*a*, an amplification unit (AMP) 4*a*, and a speaker unit 5*a* (assumed as a full-range speaker) are provided as a speaker device for Lch, and a reception device 3*b*, an amplification unit 4*b*, and a speaker unit 5*b* are also provided as a speaker device for Rch, in the same manner, with respect to the source device 1. The amplification units 4*a* and 4*b* are respectively connected to the reception devices 3*a* and 3*b*, and the speaker units 5*a* and 5*b* are respectively connected to the amplification units 4*a* and 4*b*.

Both of the reception devices 3*a* and 3*b* include main control units 30, wireless communication units 31, memories 32, error detection units 33, and signal processing units 34 including volume adjustment units 34*a*, and DACs 35 respectively connected to the amplification units 4*a* and 4*b*, and these units basically perform the same processes as the main control units 20, the wireless communication units 21, the memories 22, the error detection units 23, the signal processing units 24, and the DACs (for example, the DAC 25*m*) of FIG. 1, respectively. However, the signal processing unit 34, for example, executes the prescribed signal process of an audio signal output to the one set of the amplification unit 4*a* and the speaker unit 5*a*.

In the configuration example of FIG. 2, the DAC and the speaker unit are provided in the speaker devices to have a one-on-one relationship, as a relationship between the signal processing unit 34 and the speaker unit 5*a* and a relationship between the signal processing unit 34 and the speaker unit 5*b*. As described above, in the configuration example of FIG. 2, the amplification unit and the speaker unit are provided in a housing separated from that of the wireless communication unit 31.

In the configuration example of FIG. 2, unlike the configuration example of FIG. 1, the speaker units 5*a* and 5*b* are provided in housings different from the DACs 35, respectively, and are connected to the DACs 35 in a wired manner. In the reception devices 3*a* and 3*b* where the signal processing units 34 are provided as in this configuration example, the speaker units 5*a* and 5*b* are provided in housings different from those of the signal processing units 34 of the reception devices 3*a* and 3*b* and are connected to the signal processing units 34 of the reception devices 3*a* and 3*b* in a wired manner. Accordingly, it is possible to enjoy the effects of the audio wireless transmission system of the embodiment by using the audio wireless transmission system, by only connecting a speaker owned by a user to the reception devices. In a case of this configuration, the amplification units are also basically provided in housings different from those of the signal processing units and are connected to the signal processing units in a wired manner, in the same manner as described above, but a configuration in which the amplification units are provided in the same housings of the signal processing units can also be used.

Figure 3:
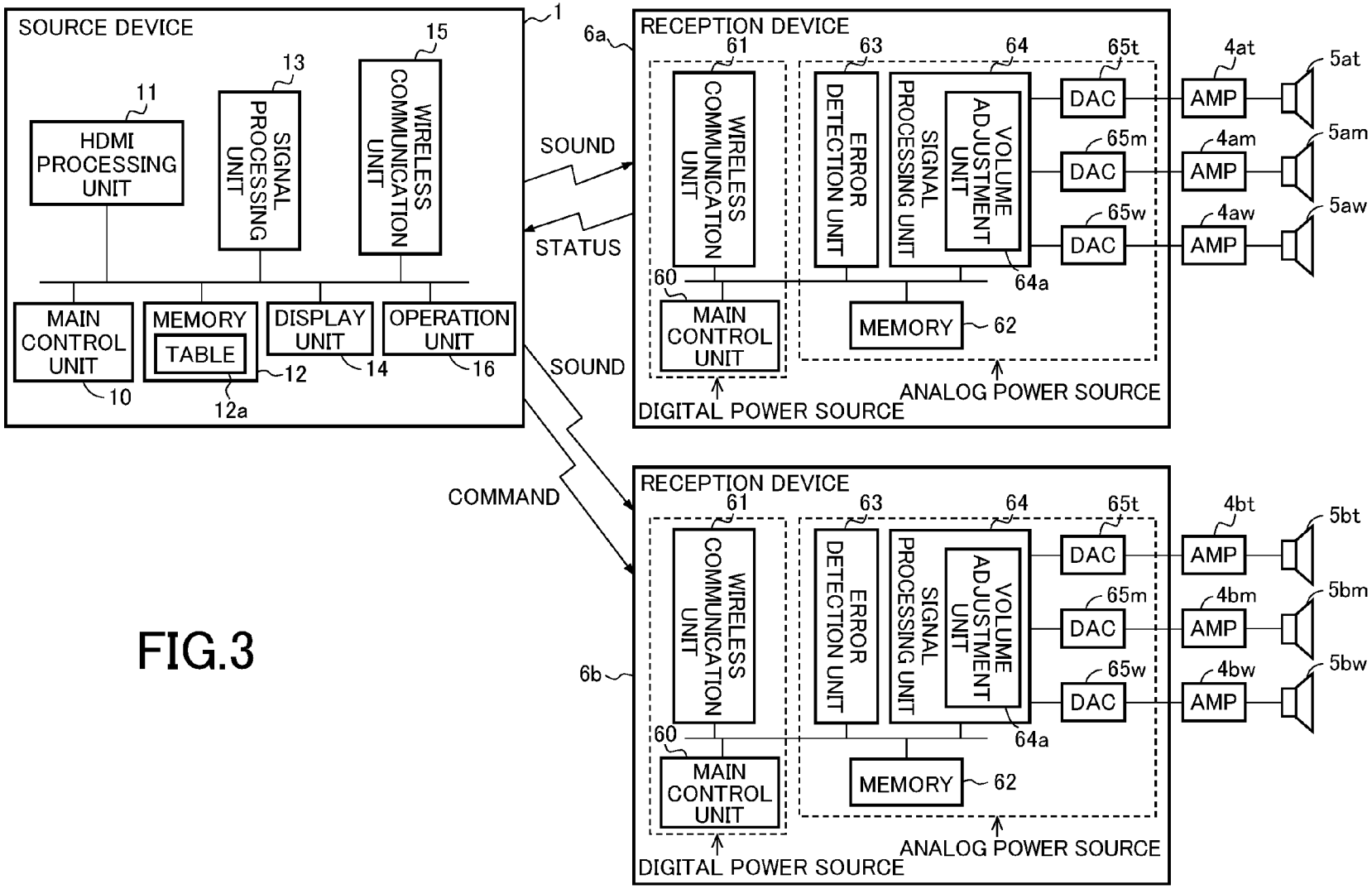
FIG. 3 is a block diagram showing another configuration example of the audio wireless transmission system according to First Embodiment of the invention.

In the configuration example shown in FIG. 3, a reception device 6*a*, amplification units (AMPs) 4*at*, 4*am*, and 4*aw*, and speaker units 5*at*, 5*am*, and 5*aw* (assumed as speakers such as a tweeter, a midrange, and a woofer, respectively) are provided as a speaker device for Lch, and a reception device 6*b*, amplification units 4*bt*, 4*bm*, and 4*bw*, and speaker units 5*bt*, 5*bm*, and 5*bw* are also provided as a speaker device for Rch, in the same manner, with respect to the source device 1.

The amplification units 4*at*, 4*am*, and 4*aw* are respectively connected to the reception device 6*a* and the speaker units 5*at*, 5*am*, and 5*aw* are respectively connected to the amplification units 4*at*, 4*am*, and 4*aw*. In addition, the amplification units 4*bt*, 4*bm*, and 4*bw* are respectively connected to the reception device 6*b* and the speaker units 5*bt*, 5*bm*, and 5*bw* are respectively connected to the amplification units 4*bt*, 4*bm*, and 4*bw*.

Both of the reception devices 6*a* and 6*b* include main control units 60, wireless communication units 61, memories 62, error detection units 63, and signal processing units 64 including volume adjustment units 64*a*, and DACs 65*t*, 65*m*, and 65*w*, and these units basically perform the same processes as the main control units 20, the wireless communication units 21, the memories 22, the error detection units 23, the signal processing units 24, and the DACs 25*t*, 25*m*, and 25*w* of FIG. 1, respectively. The DACs 65*t*, 65*m*, and 65*w* of the reception device 6*a* are respectively connected to the amplification units Oat, 4*am*, and 4*aw* and the DACs 65*t*, 65*m*, and 65*w* of the reception device 6*b* are respectively connected to the amplification units 4*bt*, 4*bm*, and 4*bw*.

The plurality of DACs are provided in the speaker devices of the configuration example of FIG. 3, in the same manner as in the configuration example of FIG. 1. In the configuration example of FIG. 3, in the same manner as in the configuration example of FIG. 2, the speaker units 5*at*, 5*am*, and 5*aw* and the speaker units 5*bt*, 5*bm*, and 5*bw* are provided in housings different from those of the DACs 65*t*, 65*m*, and 65*w*, respectively, and are connected to the DACs 65*t*, 65*m*, and 65*w* in a wired manner. As described above, in the configuration example of FIG. 3, the amplification units and the speaker units are provided in a housing separated from that of the wireless communication unit 61.

Figure 4:
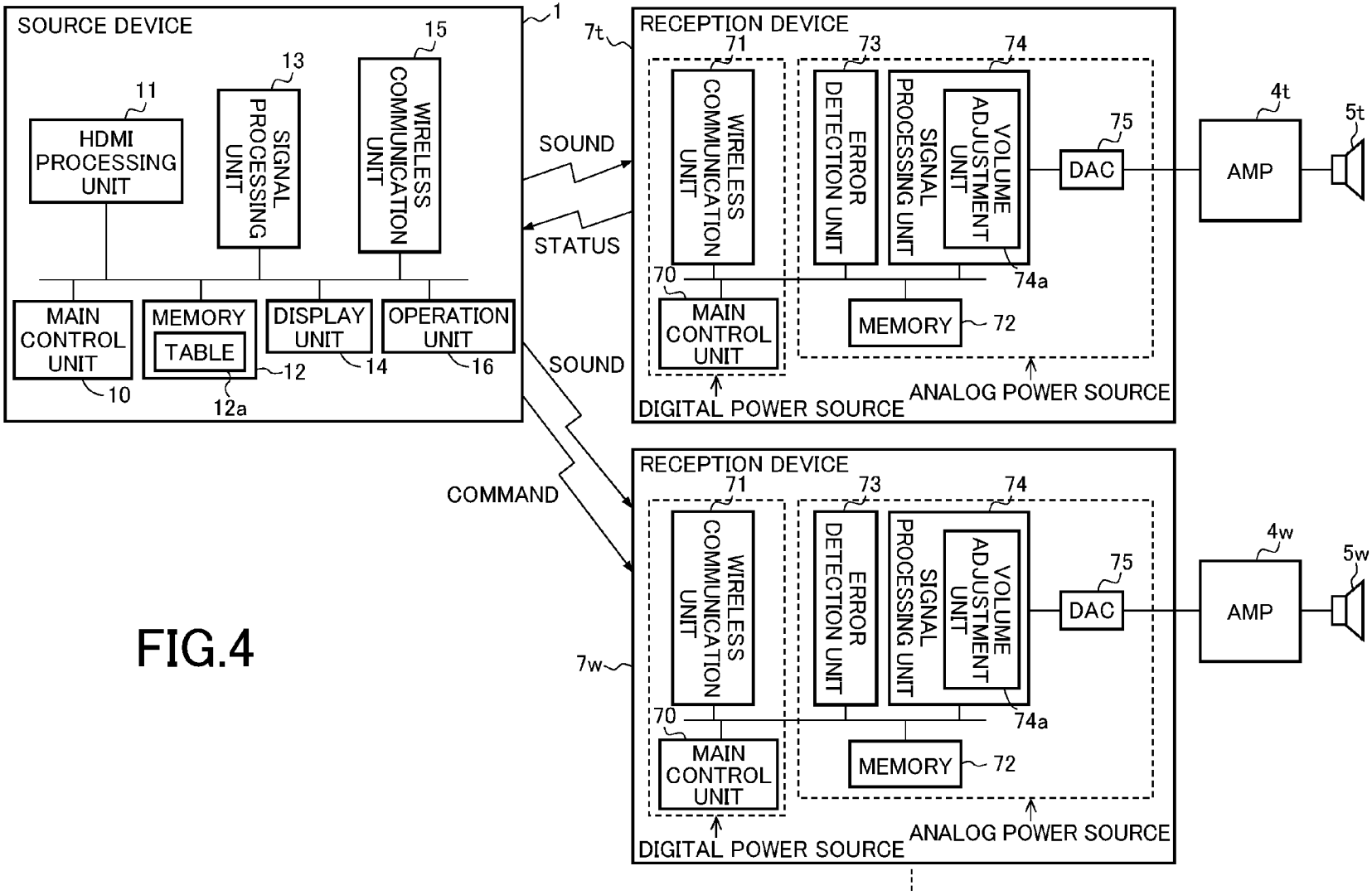
FIG. 4 is a block diagram showing another configuration example of the audio wireless transmission system according to First Embodiment of the invention.

In the configuration example of FIG. 4, a sound of one channel is reproduced by using a plurality of speaker devices. First, in this configuration example, a reception device 7*t*, an amplification unit (AMP) 4*t*, and a speaker unit 5*t* (assumed as a tweeter speaker) and a reception device 7*w*, an amplification unit 4*w*, and a speaker unit 5*w* (assumed as a woofer speaker) are provided as a speaker device for Lch, with respect to the source device 1. Herein, the amplification units 4*t* and 4*w* are respectively connected to the reception devices 7*t* and 7*w*, and the speaker units 5*t* and 5*w* are respectively connected to the amplification units 4*t* and 4*w*. A set for a midrange may be also added to the system configuration by dividing register into three parts.

Both of the reception devices 7*t* and 7*w* include main control units 70, wireless communication units 71, memories 72, error detection units 73, and signal processing units 74 including volume adjustment units 74*a*, and DACs 75 respectively connected to the amplification units 4*t* and 4*w*, and these units basically perform the same processes as the main control units 30, the wireless communication units 31, the memories 32, the error detection units 33, the signal processing units 34, and the DACs 35 of FIG. 2, respectively.

However, for example, in the reception device 7*t*, the prescribed signal process is executed with respect to the received audio signal for Lch by the signal processing unit 74, in order to generate an audio signal (audio signal for a tweeter) to be output to one set of the amplification unit 4*t* and the speaker unit 5*t*. In the same manner as described above, in the reception device 7*w*, the prescribed signal process is executed with respect to the received audio signal for Lch by the signal processing unit 74, in order to generate an audio signal (audio signal for a woofer) to be output to one set of the amplification unit 4*w* and the speaker unit 5*w*.

The one DAC is provided in each speaker device of the configuration example of FIG. 4, in the same manner as in the configuration example of FIG. 2. In addition, in the configuration example of FIG. 4, the speaker units 5*t* and 5*w* are provided in housings different from the DACs 75 and are connected to the DACs 75 in a wired manner, in the same manner as in the configuration example of FIG. 2. As described above, in the configuration example of FIG. 4, the amplification units and the speaker units are provided in the same housing as that of the wireless communication unit 71.

However, in the configuration example of FIG. 4, audio signals for one channel are received and reproduced by using two speaker devices, unlike the configuration example of FIG. 2.

In addition, in this configuration example, although not shown, a speaker device for Rch also has the same configuration as that of the speaker devices for Lch.

The configuration examples shown in FIG. 1 to FIG. 4 can be suitably combined with each other. Various combinations can be assumed and an example thereof will be described. For example, in the configuration example of FIG. 1, the system can be constituted so as to dispose the speaker device 2*a* for a left front channel (Lch), dispose the speaker device 2*b* for a right front channel (Rch), and dispose all of the speaker devices of FIG. 2 (for example, the reception device 3*a*, and amplification unit 4*b*, and the speaker unit 5*a*) for a left rear (left surround) channel (LSch) and for a right rear channel (RSch). In this case, for example, a speaker device for a center channel may be provided in the same housing as that of the source device 1 and configured to perform wired transmission, and the speaker device 2*a* of FIG. 1 may be used or other configurations may be used.

In addition, in any of the configuration examples of FIG. 1 to FIG. 4 or the configuration examples of the combinations thereof, a configuration of providing a plurality of speaker devices with respect to one amplification unit can also be used. In a case of this configuration, when a filter such as an LC filter for a speaker unit to be a target is provided, that is, a network filter is provided in a fore stage of each speaker unit, as an output destination of an amplification unit, the output can be performed from each speaker unit in different frequency bands.

Hereinafter, specific examples of the error information or the operation request of each configuration example described above will be described with reference to FIG. 5A to FIG. 13. The example of the error information or the operation request is not limited thereto and a description method is not limited to the following example, either.

First, a specific example of parameters transmitted from a speaker device to a source device (that is, reception parameters received by the source device) will be described as the error information, with reference to FIG. 5A to FIG. 5C. FIG. 5A is a diagram showing an example of reception parameters received by a source device side from a speaker device side in the audio wireless transmission system according to the embodiment. FIG. 5B is a diagram showing an example of Device Type among the reception parameters of FIG. 5A and FIG. 5C is a diagram showing an example of Status among the reception parameters of FIG. 5A.

As the reception parameters, a type of device in the reception device (Device Type) and a state of the device (Status) shown in a table 81 of FIG. 5A can be used. A main control unit, a wireless communication unit (on a reception device side of a sound, corresponding to a reception unit, that is, the wireless reception unit described above), a volume adjustment unit, a DAC, an AMP, an analog power source unit, and a digital power source unit shown in a table 82 of FIG. 5B are used as items for Device Type.

Normal, an overcurrent, a reduced voltage (voltage drop), an overtemperature, an abnormal voltage, a current offset, a clock abnormality, a clock stop, and a system abnormality as shown in table 83 of FIG. 5C are, for example, used as items for Status (error status) which are states of the device. As shown in the table 83, these items may be divided whether the state thereof is in a warning stage or in a fatal stage (fatal state) or may be divided whether or not the state thereof is fatal by setting a separate flag. Each status will be described together with a process example when the status is set.

As described above, the source device 1 can receive a warning for a monitored target as error information, by containing information indicating at least one warning among an overcurrent warning, a voltage drop warning, an overtemperature warning, a voltage abnormality warning, a current offset warning, a clock abnormality warning, a clock stop warning, and a system abnormality warning. In addition, the source device 1 can also employ a configuration in which a process different from a process to be executed in a fatal stage is executed in a stage of a warning.

Next, a specific example of transmission parameters transmitted from the source device 1 with respect to the specific example of the reception parameters described above will be described with reference to FIG. 6A to FIG. 6C. FIG. 6A is a diagram showing an example of the transmission parameters transmitted from the source device side to the speaker device side in the audio wireless transmission system according to the embodiment. FIG. 6B is a diagram showing an example of Device Type among the transmission parameters of FIG. 6A and FIG. 6C is a diagram showing an example of Command among the transmission parameters of FIG. 6A.

As the transmission parameters, a type of device in the reception device (Device Type), a command showing a content of an operation request (Command), and a parameter of the command (Parameter) can be used as shown in a table 91 of FIG. 6A. There are also commands which do not need parameters. A main control unit, a wireless communication unit (on a reception device side of a sound, corresponding to a reception unit, that is, the wireless reception unit described above), a volume adjustment unit, a DAC, and an AMP shown in a table 92 of FIG. 6B, and an analog power source unit (not shown) and a digital power source unit (not shown) are used as items for Device Type.

As shown in a table 93 of FIG. 6C, a return, a power supply stop, volume adjustment (in this case, a volume value is configured as Parameter), a reset, temperature measurement, voltage measurement, and clock measurement are used as items for Command.

Next, a specific example of parameters (referred to as response parameters) transmitted from the speaker devices 2*a* and 2*b* side to the source device 1 side with respect to the specific example of the transmission parameters described above will be described with reference to FIG. 7A to FIG. 7C. FIG. 7A is a diagram showing an example of response parameters transmitted from a speaker device side to a source device side in the audio wireless transmission system according to the embodiment. FIG. 7B is a diagram showing an example of Device Type among the response parameters of FIG. 7A and FIG. 7C is a diagram showing an example of Status among the response parameters of FIG. 7A.

As the response parameters, a type of device in the reception device (Device Type), a state of the device (Status), and a parameter showing the state (Parameter) shown in a table 101 of FIG. 7A can be used. A measurement value is described as Parameter, but there is also a device state which does not need Parameter. A main control unit, a wireless communication unit (on a reception device side of a sound, corresponding to a reception unit, that is, the wireless reception unit described above), a volume adjustment unit, a DAC, and an AMP shown in a table 102 of FIG. 7B, and an analog power source unit (not shown) and a digital power source unit (not shown) are used as items for Device Type.

As shown in a table 103 of FIG. 7C, a return, a power supply stop, current volume acquisition, a reset, temperature measurement, voltage measurement, and clock measurement are used as items for Status which are states of the device. Herein, Status indicating that the process is completed and Status indicating that the process is in progress are described as respective items. That is, Status changes by determining whether or not the operation is completed. In addition, Parameter is configured for at least items accompanied with measurement (or detection) among items of Status indicating that the process is completed. In a case where the current volume acquisition is completed, a volume value is configured, and in a case where the measurement of a temperature, a voltage, and a clock is completed, a temperature measurement value, a voltage measurement value, and a clock measurement value are configured, respectively.

Next, a process regarding the parameters described above will be schematically described by using the configuration example of FIG. 1 as an example. The description can also be applied with other configuration examples, in the same manner.

First, the error detection unit 23 monitors states of the DACs 25*t*, 25*m*, and 25*w* or the amplification units 26*t*, 26*m*, and 26*w*, determines that an error has occurred, in a case where a temperature or a driving state changes, and feeds error information back to the main control unit 20. The main control unit 20 monitors even an error occurred in the main control unit (internal error). When an error has occurred in the speaker device 2*a*, the main control unit 20 of the speaker device 2*a* transmits the error information to the source device 1. A case where an internal error which is a type which cannot be transmitted as described above has occurred in the main control unit 20, cannot be coped with by means of the process of the embodiment, but other errors which more frequently occur can be coped with.

Figure 8:
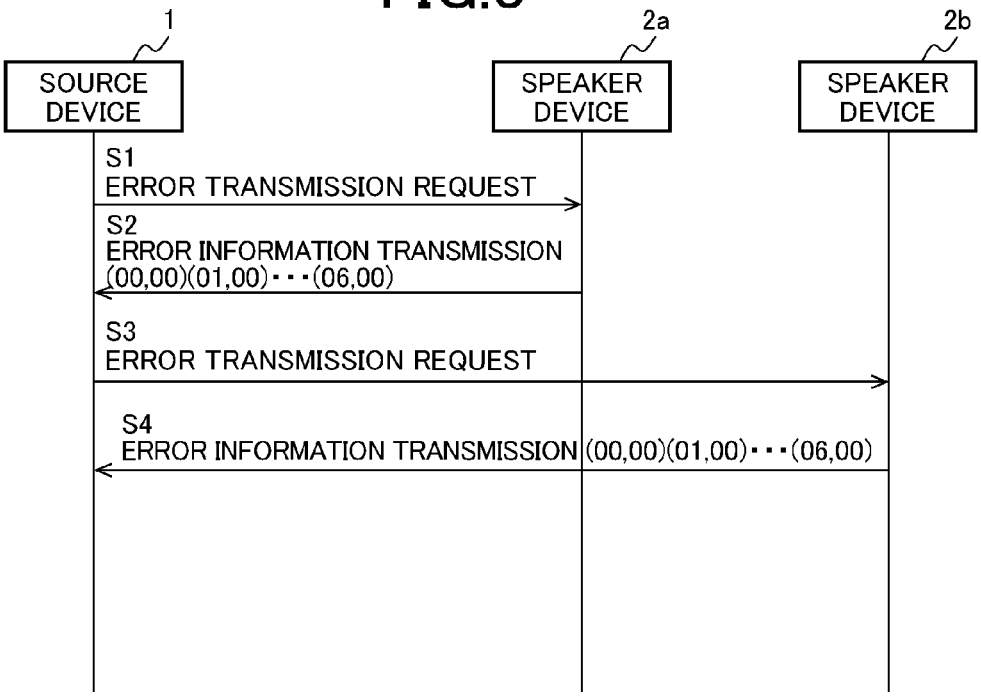
FIG. 8 is a sequence diagram for illustrating an example of a process procedure of the audio wireless transmission system according to First Embodiment of the invention.

In the above description, the embodiment is described by assuming that the error information regarding an initial error is spontaneously transmitted from the speaker device side. However, the source device 1 side can also make a request of the speaker device for the error information. This process will be described with reference to FIG. 8. FIG. 8 is a sequence diagram for illustrating an example of a process procedure of the audio wireless transmission system according to the embodiment.

First, the source device 1 transmits an error transmission request to the speaker device 2*a* (Step S1) and the speaker device 2*a* transmits error information at that point of time in response thereto (Step S2). When all devices are in a normal state, error information (00,00) (01,00) (02, 00) (03, 00) (04, 00) (05, 00) (06, 00) is transmitted. Herein, the examples of FIG. 5A to FIG. 5C are used as the reception parameters (error information), but the description of "0x" is omitted for convenience of description.

The speaker device 2*a* may reply the error information by executing the error detection process at the point of time the error transmission request is received, or may reply the error information which is stored so far. In a former case, the error transmission request corresponds to a designation of measurement and detection of error information.

The same process as in Steps S1 and S2 is also performed for the speaker device 2*b* (Steps S3 and S4). The order of transmitting the error transmission request by the source device 1 is not limited thereto and may be a prescribed order. In addition, the error transmission request may be transmitted by radio using broadcast or multicast delivery. Further, the timing of the error transmission request may be arbitrarily determined and may be set at intervals of several seconds, for example. Therefore, it is not necessary that the error information be spontaneously transmitted from the speaker device side, and the collection of the error information regarding the plurality of speaker devices can be performed at the same time.

In this way, the source device 1 receives the error information. The source device 1 refers to the table 12*a* in the memory 12, generates the transmission parameter by reading out a command corresponding to the reception parameter, (or reads out the transmission parameter corresponding to the reception parameter), and transmits the transmission parameter to the other speaker device 2*b* by radio.

Herein, an ID or the like indicating the speaker device is added to the reception parameter and an ID indicating the other speaker device is added to the transmission parameter (an ID other than the ID contained in the reception parameter among IDs stored in the memory in advance is searched and added), and accordingly, the transmission parameter can be transmitted to the other speaker device as the operation request signal. The transmission parameter can be simply transmitted by radio using broadcast or multicast delivery, in a state where the speaker device where error has occurred is also contained.

The main control unit 20 of the other speaker device 2*b* may analyze which control signal the transmission parameter received by the wireless communication unit 21 is (which command the transmission parameter contains), and control a part which is a control target to execute an operation indicated by the transmission parameter.

For example, in a case where an error due to any disturbance is detected in an amplification unit of a certain speaker device, as soon as the main control unit 20 of the speaker device controls the analog power source unit to turn off (block) the analog power source, it transmits the reception parameter to the source device 1 to perform notification for emergency stop.

The main control unit 10 of the source device 1 receives the reception parameter and makes a stop request of the speaker device (reception device) other than the speaker device where the disturbance has occurred, by transmitting a transmission parameter indicating to immediately turn off the analog power source. Each reception device receives the stop request and stops the operation of the analog power source. The source device 1 may display that the sound output is stopped and the operation of the analog power source of each reception device is stopped due to occurrence of a problem on the display unit 14.

The command transmitted as the transmission parameter is not limited thereto. For example, in a case where the command is a volume change control command, the main control unit 20 of the speaker device 2*b* transmits a change instruction (volume set value or the like) to the volume adjustment unit 24*a*, and in a case where the command is an audio mute ON/OFF command, the main control unit transmits an ON/OFF signal to the DACs 25*t*, 25*m*, and 25*w* and the amplification units 26*t*, 26*m*, and 26*w*.

A command (operation request) regarding the error occurrence in the DAC may be a command with respect to an equivalent part as the error occurrence part of the other speaker device, as described above. However, in the combined configuration example described above, an operation request for stopping the operation of only a part (for example, the amplification unit 26*t* or all of the amplification units) where the error has occurred is performed in the speaker device 2*a* of the configuration example of FIG. 1, but the amplification unit corresponding thereto is not a control target of the main control unit 30 in the configuration example of FIG. 2. Since such a system configuration is also assumed, in a case where such an operation request is received, the main control unit 30 may perform the control in a safer manner. In a case of this example, the output of the audio signal to the amplification unit 4*a* may be stopped by blocking the analog power source and stopping the operation of the DAC 35.

In a case where the error information is received, the source device 1 may instruct the speaker device (for example, the speaker device 2*a*) where the error is detected, to measure and detect error relevant information which is information relating to the error indicated by the received error information, in order to obtain more specific error information. Herein, the source device may also instruct the speaker device (for example, the speaker device 2*b*) other than the speaker device where the error is detected, to measure and detect the error relevant information, in the same manner. That is, the source device may instruct some or all of the speakers in the system to measure and detect the error relevant information. By performing such a process, the source device 1 can collect specific information regarding the error from the speaker device 2*a* (and the speaker device 2*b*). An example of the error relevant information will be described in the following process example.

Hereinafter, as second to sixth embodiments of the invention, specific process examples using the parameters shown in FIG. 5A to FIG. 7C will be described with reference to each drawing of FIG. 9 to FIG. 13. FIG. 9, FIG. 10, FIG. 11, FIG. 12, and FIG. 13 are respectively sequence diagrams for illustrating examples of process procedures in cases where an overcurrent, an overtemperature of an AMP, an abnormal voltage, a clock abnormality, and a system abnormality are detected.

Herein, a process example in a case where the error detection unit 23 of the speaker device 2*a* has detected an error, for example, in a case where the operation of the speaker device 2*a* of the configuration example of FIG. 1 is stopped due to an overcurrent, a reduced voltage, an overtemperature, an abnormal voltage, a current offset, a clock abnormality, a clock stop, or a system abnormality will be described. Herein, the same applies to a case where the error detection unit 23 of the speaker device 2*b* has detected an error, and other configuration examples as described above. In addition, the same applies, even when the number of speaker devices is changed. In the following description, the examples of FIG. 5A to FIG. 7C are used as the reception parameters (error information), the transmission parameters, and the response parameters, but the description of "0x" is omitted for convenience of description.

Second Embodiment

(1) Case where Overcurrent is Detected

Figure 9:
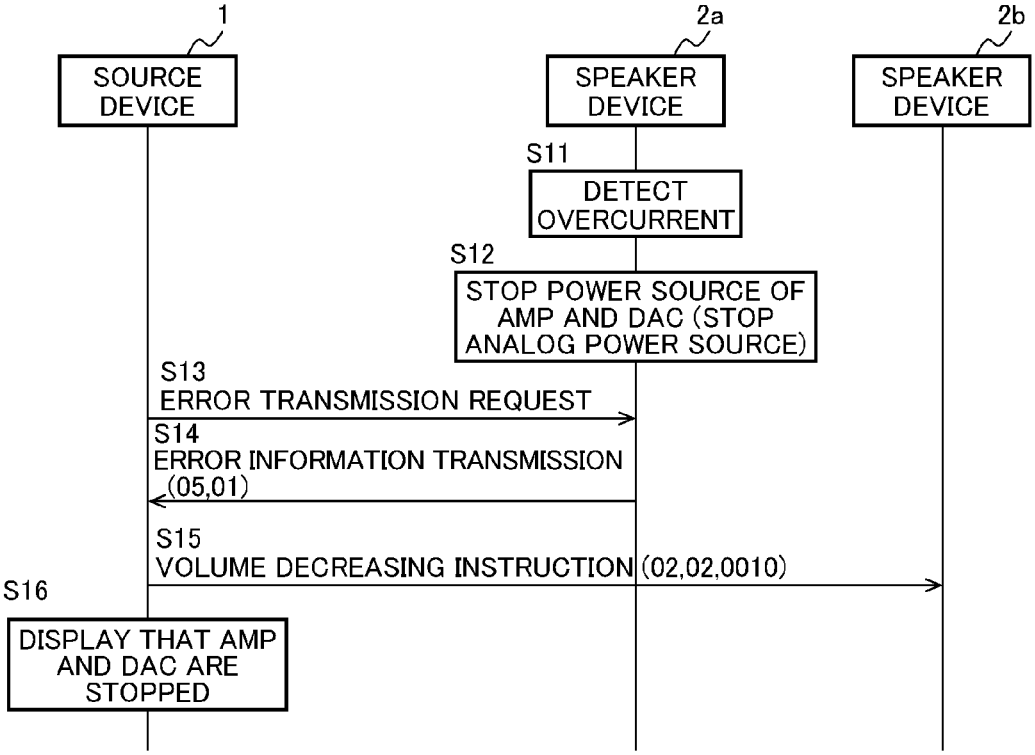
FIG. 9 is a sequence diagram for illustrating an example of a process procedure in a case where an overcurrent is detected in an audio wireless transmission system according to Second Embodiment of the invention.

FIG. 9 shows a sequence diagram of a case where an overcurrent has occurred in the analog power source in the speaker device 2*a*. The analog power source is a power source of the error detection unit 23, the signal processing unit 24, each DAC (DAC 25*t* and the like), and each AMP (amplification unit 26*t* and the like). It is necessary that electric power supplied by the analog power source be increased, in order to drive the speakers connected to the AMP producing a large output. When electric power necessary for the AMP exceeds predetermined electric power of the analog power source, the analog power source falls in an overcurrent state. When this state is continued, a possibility of degradation and breakage of components in the analog power source increases.

The error detection unit 23 detects whether or not the analog power source is in the overcurrent state (Step S11). This detection is, for example, performed by using a result obtained by adding up voltage values of a current monitoring resistor in a circuit for a prescribed period of time. When, the overcurrent state of the analog power source is detected, the error detection unit 23 notifies the main control unit 20 of the detection. The main control unit 20 which receives this notification immediately stops the operation of the power source of each AMP and each DAC (Step S12). This is because AMP and the like may be broken, when the overcurrent state is continued. At this time, the operation of the entire analog power source may be stopped.

The error transmission request is regularly transmitted to each speaker device from the source device 1 (Step S13). The error transmission request is transmitted at intervals of approximately one second, for example. The error process in each speaker device is instantly performed, but the information notification to another device may be performed at any timing, as long as it is fast enough in human sense. FIG. 9 only shows the error transmission request with respect to the speaker device 2*a*. With respect to the error transmission request, the error information (05,01) is transmitted to the source device 1 from the speaker device 2*a* (Step S14). First two digits of the error information represent the type of the device and the following two digits represent the content of the error. In this example, "05" means that the type of the device is the analog power source, and "01" means that the content of the error is the overcurrent and is in a warning level. When there is no error, information (00,00) (01,00) (02,00) (03,00) (04,00) (05,00) (06,00) showing that each device is normal is transmitted as the status as shown in FIG. 8.

The main control unit 10 of the source device 1 transmits a volume decreasing instruction, for example, to the speaker device 2*b* other than the speaker device 2*a* through the wireless communication unit 15 (Step S15). The transmitted content is, for example, (02,02,0010). Herein, first two digits represent a type of the device, the following two digits represent a command, and the following four digits represent a command parameter. In this example, the first "02" means that the type of the device is the volume adjustment unit, and the following "02" means that the command is volume adjustment. "0010" is an example of a volume value. In addition, the display unit 14 of the source device 1 displays that the operation of the AMP and the DAC are stopped due to occurrence of an error (Step S16).

With this series of the control sequence, it is possible to prevent the speaker device 2*a* from being broken and avoid the indecisive state where the other speaker device 2*b* continuously makes sound, and it is possible to accurately inform a user of abnormality. In addition, a user may not feel unnecessary sense of unease, by suitably displaying abnormality.

(2) Case where Reduced Voltage is Detected

A case where a reduced voltage is detected will be described. The reduced voltage indicates that a power source voltage is decreased to be lower than a predetermined value. When power consumption of a device is increased, this may cause a decrease in power source voltage depending on an impedance of the AC power source. When the power source voltage is decreased to be lower than a predetermined value, an audio output level is directly affected, and accordingly, high-quality sound cannot be maintained.

The reduced voltage is, for example, detected in an input part of the analog power source. In a case where the reduced voltage is detected, normal electric power supply cannot be performed, and accordingly, the DAC and the AMP may be broken. Thus, the AMP and the DAC are in a stop state. The source device 1 displays that the reduced voltage is a reason on the display unit 14 and makes a user to confirm the speaker device 2*a*. In the other speaker device 2*b* where the reduced voltage is not detected, the volume is decreased due to the operation request from the source device 1 as described in Step S15. By performing this operation, it is possible to immediately accurately recognize the stop due to abnormality. Since it is recognized that the reduced voltage is a reason, it is possible for a user to accurately cope with reinforcement of the AC power source.

Third Embodiment (3) Case where Overtemperature is Detected

Figure 10:
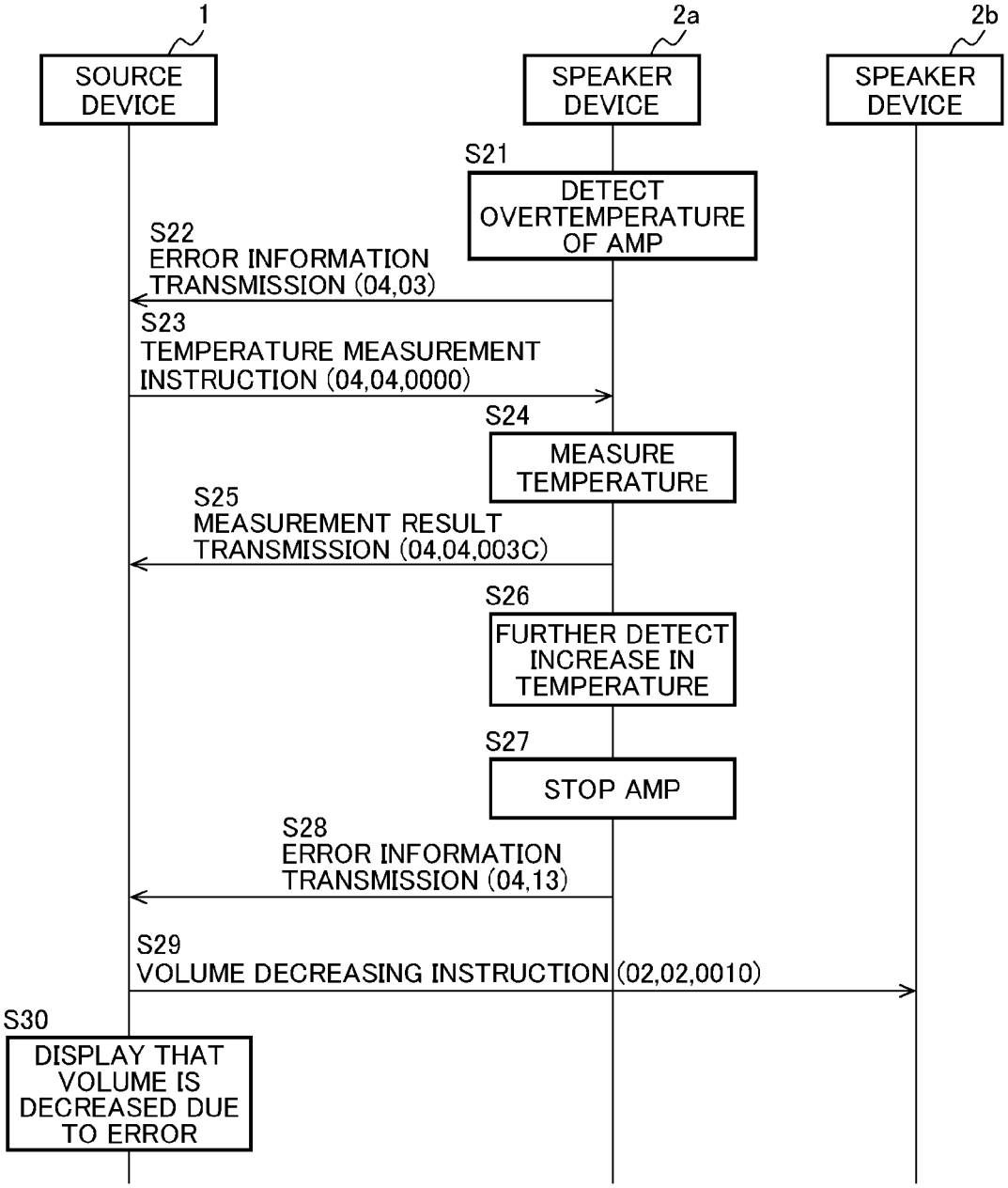
FIG. 10 is a sequence diagram for illustrating an example of a process procedure in a case where an overtemperature of an amplification unit is detected in an audio wireless transmission system according to Third Embodiment of the invention.

FIG. 10 shows a sequence of a case where an overtemperature has occurred in the AMP in the speaker device 2*a*. The higher sound output is, the more an electric energy of the AMP increases. Accordingly, the temperature of the AMP is easily increased. When the temperature thereof exceeds a predetermined level, significant effects are applied to the constituted electronic components and the effects become a reason of degradation and breakage.

The error detection unit 23 successively measures the temperature with a temperature sensor embedded in the AMP and transmits the measurement value to the main control unit 20 as a detection result. The main control unit 20 determines that the overtemperature has occurred, when the detected temperature is higher than the predetermined temperature. When the overtemperature is detected (Step S21), the main control unit 20 of the speaker device 2*a* transmits the error information to the source device 1 through the wireless communication unit 21 (Step S22). The transmitted content is (04,03). Herein, "04" means that the type of the device is the AMP and "03" means that the content of the error is the overtemperature and is in a warning level.

In the Second Embodiment, the transmission request of the error information is regularly made from the source device 1 to the speaker devices 2*a* and 2*b* and an error value is transmitted from the speaker device 2*a* where the error is detected to the source device 1, but as described in this embodiment, in a case where more rapid process is necessary, the speaker device 2*a* where the error is detected, spontaneously transmits the error information to the source device 1.

The source device 1 transmits a temperature measurement instruction to the speaker device 2*a* (Step S23). This temperature measurement instruction is an instruction of making a request for a temperature measurement value which is an example of the error relevant information and the transmitted content is (04,04,0000). Herein, first two digits represent a type of the device, the following two digits represent a command, and the following four digits represent a command parameter. In this example, the first "04" means that the type of the device is the AMP and the following "04" means that the command is temperature measurement. The last "0000" means that "a command parameter is not necessary in this command" and this is represented with zero.

The main control unit 20 of the speaker device 2*a* receives the temperature measurement instruction through the wireless communication unit 21 and instructs the error detection unit 23 to measure a temperature (Step S24). The temperature measurement result is transmitted to the main control unit 20 from the error detection unit 23, measurement result data showing the measurement result thereof is generated by the main control unit 20 and is transmitted to the source device 1 through the wireless communication unit 21 (Step S25). The measurement result data of this example is (04,04,003C). Herein, first "04", the following "04" and the last "003C" respectively mean the AMP, the temperature measurement result, and 60 degrees. FIG. 10 shows the process once, but the measurement is successively performed as long as the overtemperature is continued.

When the temperature is equal to or lower than the regulated temperature, the overtemperature (warning) is released and the temperature measurement is stopped. The example of FIG. 10 is a case where the temperature is further increased and is detected (Step S26). In this case, the main control unit 20 of the speaker device 2*a* determines that the temperature of the AMP is a fatal value and immediately stops the operation of the AMP (Step S27). Then, the main control unit 20 transmits the error information to the source device 1 through the wireless communication unit 21 (Step S28). The content of the error information to be transmitted is (04,13) meaning that the temperature of the AMP is a fatal overtemperature.

Hereinafter, in the same manner as in the cases of (1) and (2) described above, the source device 1 transmits a volume decreasing instruction (02,02,0010) to the other speaker device 2*b* (Step S29). Herein, the first "02" means that the type of the device is the volume adjustment unit 24*a*, the following "02" means that the command is volume adjustment, and the last "0010" represents a volume value. The reason why the volume is decreased without stopping the operation is because the playing can be continued by returning the volume to the original value, when the temperature of the AMP of the speaker device 2*a* is decreased. The display unit 14 of the source device 1 displays that the volume is decreased due to an error (Step S30).

By performing such a process, the error which comparatively easily occurs such as an increase in temperature in the speaker device can be coped with in a stepwise manner, in accordance with the state of an increase in temperature. It is possible to inform a user of an increase in temperature in the speaker device and to inform a user of a possibility of a return, when a temperature is decreased, and accordingly, a user does not concern about the problem unnecessarily.

Fourth Embodiment (4) Case where Abnormal Voltage is Detected

Figure 11:
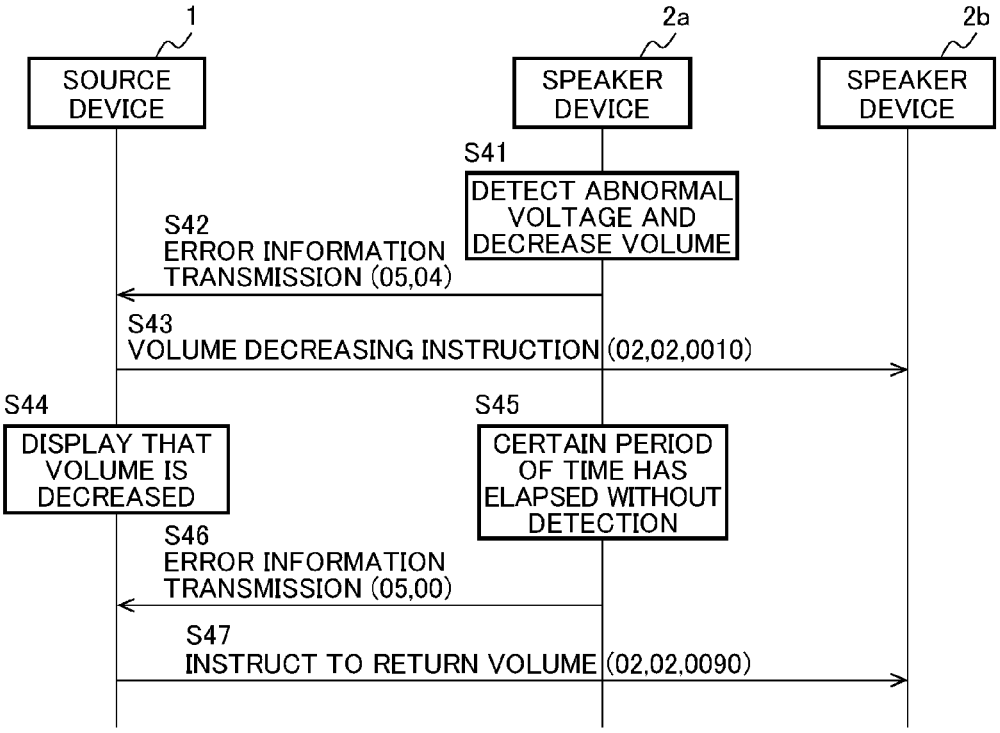
FIG. 11 is a sequence diagram for illustrating an example of a process procedure in a case where an abnormal voltage is detected in an audio wireless transmission system according to Fourth Embodiment of the invention.

FIG. 11 shows a sequence of a process in a case where the voltage of the analog power source is an abnormal voltage in the speaker device 2*a* and a return process in a case where no abnormality is detected. FIG. 11 shows a case where a power source voltage supplied to each block from the analog power source of the speaker device 2*a* is beyond a normal value. The reason thereof is a case where voltage fluctuation of the AC power source is not completely absorbed or a case where a load of each block is rapidly changed, for example. In any cases, when an abnormal voltage is continued for a long time, breakage of a circuit is caused, and accordingly, it is necessary to immediately cope with the error.

The error detection unit 23 successively measures a value of the power source voltage supplied to each block from the analog power source and transmits the measured value to the main control unit 20 as the detection result. The main control unit 20 determines that the detected voltage is an abnormal voltage, in a case where fluctuation in which the detected voltage exceeds, for example, ±10% of the predetermined voltage value is detected.

When an abnormal voltage is detected, the main control unit 20 immediately instructs the AMP to decrease the volume (Step S41). For example, the main control unit instructs to decrease the volume to the minimum volume. Then, the main control unit 20 of the speaker device 2*a* transmits the error information to the source device 1 through the wireless communication unit 21 (Step S42). The transmitted content is (05,04). Herein, first "05" means that the type of the device is the analog power source, and the following "04" means that the content of the error is an abnormal voltage and is in a warning level.

The source device 1 which receives the error information transmits the volume decreasing instruction to the other speaker device 2*b* (Step S43). The transmitted content is (02,02,0010) and the meaning thereof is as described in Step S29. The reason why the volume is decreased without stopping the operation is that the playing can be continued by returning the volume to the original value, when the output voltage of the analog voltage of the speaker device 2*a* is within a predetermined value. The display unit 14 of the source device 1 displays that the volume is decreased due to an error (Step S44).

The speaker device 2*a* continuously detects the voltage of the analog voltage and confirms whether or not a certain period of time has elapsed from a stage where the abnormal voltage is no longer detected (Step S45). The main control unit 20 of the speaker device 2*a* determines that the error of the abnormal voltage is resolved, and transmits the error information to the source device 1 through the wireless communication unit 21 (Step S46). The transmitted content is (05,00). Herein, first "05" means that the type of the device is the analog power source, and the following "00" means that the content of the error is normal.

The source device 1 by which the information is received, determines that the speaker device 2*a* returns to normal, and transmits an instruction of increasing the volume (an instruction of returning the volume) to the other speaker device 2*b* (Step S47). The transmitted content is (02,02,0090). Herein, first "02" means that the type of the device is the volume adjustment unit 24*a*, the following "02" means that the command is volume adjustment, and the last "0090" represents a volume value. In the speaker device 2*b* which receives this instruction, the main control unit 20 instructs the volume adjustment unit 24*a* to set a volume value as "90".

The speaker device 2*a* may be configured so as to perform a process of returning the volume to an original state in a return sequence. However, in a case where the same error is repeatedly detected several times, the volume may be maintained in a reduced state. In Step S47, the source device 1 may transmit the same instruction of increasing the volume to the speaker device 2*a* which has returned to normal.

By performing such a process, it is possible not only to rapidly correspond to the state of the other speaker device with respect to the abnormality of the speaker device but also to cause the volume of the other speaker device to return rapidly, even after the recovery of the speaker device from an error, and accordingly, a user does not feel needless concern about the problem and convenience is obtained.

(5) Case where Current Offset is Detected (Case where DC Component is Present in Audio Signal)

In the same manner as in (4) described above, the volume is decreased, because the speaker may be broken. The process after that is the same as that in (4) described above.

Fifth Embodiment (6) Case where Clock Abnormality is Detected

Figure 12:
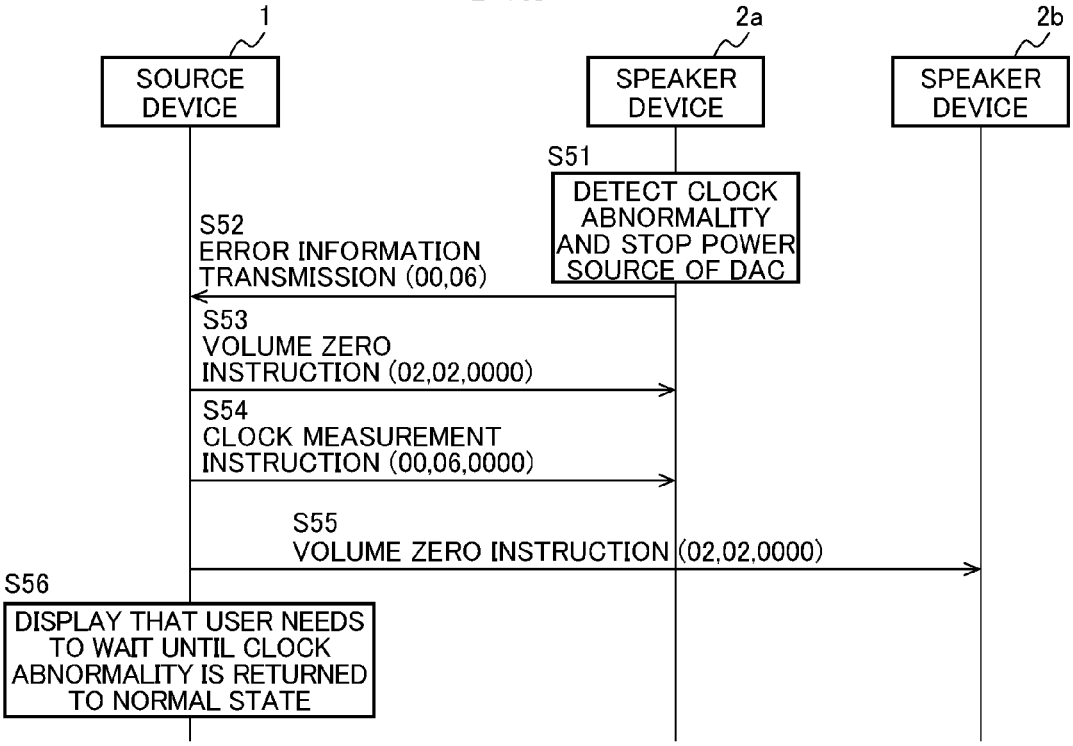
FIG. 12 is a sequence diagram for illustrating an example of a process procedure in a case where a clock abnormality is detected in an audio wireless transmission system according to Fifth Embodiment of the invention.

FIG. 12 shows a sequence of a case where a clock for the DAC control is abnormal in the speaker device 2*a*. The clock abnormality is a state where a clock supplied from the main control unit 20 to the DAC has a time variation or an intermittent oscillation. The wiring resistance may increase or fluctuate due to noise or induction due to aging degradation. When a time fluctuation is small, a sense of incompatibility at the time of listening the sound is felt, but when there is a significant fluctuation or intermittent oscillation, the output of the DAC is damaged, and this causes the breakage of the AMP and the speaker unit.

The error detection unit 23 successively measures a fluctuation of a clock for the DAC of the speaker device 2*a* and transmits the measured value to the main control unit 20 as the detection result. The main control unit 20 determines that the clock abnormality is detected, when a fluctuation in which a jitter value which is the detected fluctuation value of the clock, for example, exceeds ±1%.

The main control unit 20 immediately stops the operation of the power source of the DAC, when the clock abnormality is detected (Step S51). Then, the main control unit 20 of the speaker device 2*a* transmits the error information to the source device 1 through the wireless communication unit 21 (Step S52). The transmitted content is (00,06). Herein, the first "00" means that the type of the device is the main control unit 20, and the following "06" means that the content of the error is a clock voltage and is in a warning level.

The source device 1 in which the error information is received transmits a clock measurement instruction to the speaker device 2*a* (Step S54). The transmitted content is (00,06,0000). Herein, the first "00" means that the type of the device is the main control unit 20, the following "06" means that the command is an instruction of clock measurement, and the last "0000" means that "a command parameter is not necessary in this command". Instead of the clock measurement instruction, an instruction of simply making a request for only determining absence or presence of a clock may be performed. The clock measurement value or the absence or presence of the clock is an example of the error relevant information described above.

Before or after Step S54, the source device 1 transmits a request of setting the volume to zero, that is, a volume zero instruction, to the speaker device 2*a* (Step S53). The transmitted content of the volume zero instruction is (02,02, 0000). Herein, first "02" means that the type of the device is the volume adjustment unit 24*a*, the following "02" means that the command is volume adjustment, and the last "0000" represents that the volume value is zero. The source device 1 performs the same instruction with respect to the other reception device (that is, the speaker device 2*b*) (Step S55). Regarding Steps S53 and S55, the clock abnormality may be an fatal error with respect to the sound, and accordingly, the sound is instructed to be completely mute.

Before or after Step S54, the source device 1 notifies a user of a current state by displaying that the clock abnormality is detected and it is necessary to wait until the normal state is recovered (or it is necessary to confirm the speaker device 2*a*) on the display unit 14 (Step S56).

The speaker device 2*a* by which the clock measurement instruction is received suitably returns the clock measurement result to the source device 1. In a case where the clock measurement result is returned to a normal state, the source device 1 causes the speaker device 2*a* to restart the electric power supply to the DAC. After a certain period of time has elapsed from the restarting, all of the reception devices (that is, the speaker devices 2*a* and 2*b*) are instructed so as to return the volume to an original state. At this time, the content notified in Step S56 may be removed and the display unit 14 may display that the volume is returned to a normal state for a certain period of time, with the removal.

As described above, in the embodiment, the error which easily become a fatal error with respect to the sound having clock abnormality is urgently coped with, and this is notified to a user, and accordingly, a user can perform a suitable operation and convenience for a user is provided.

(7) Case where Clock Stop is Detected (Case where Clock of Main Control Unit 20 is Stopped)

The same process as in (6) described above is performed.

Sixth Embodiment (8) Case where System Abnormality is Detected (Case where Abnormality of Entire System of Speaker Device 2*a* has Occurred)

When it is determined that the system abnormality has occurred, a reset or the like is performed according thereto by the main control unit 20 of the speaker device 2*a*, but when the main control unit 20 hangs up, it becomes impossible to respond to the error transmission request. A sequence of such a case will be described according to FIG. 13.

Figure 13:
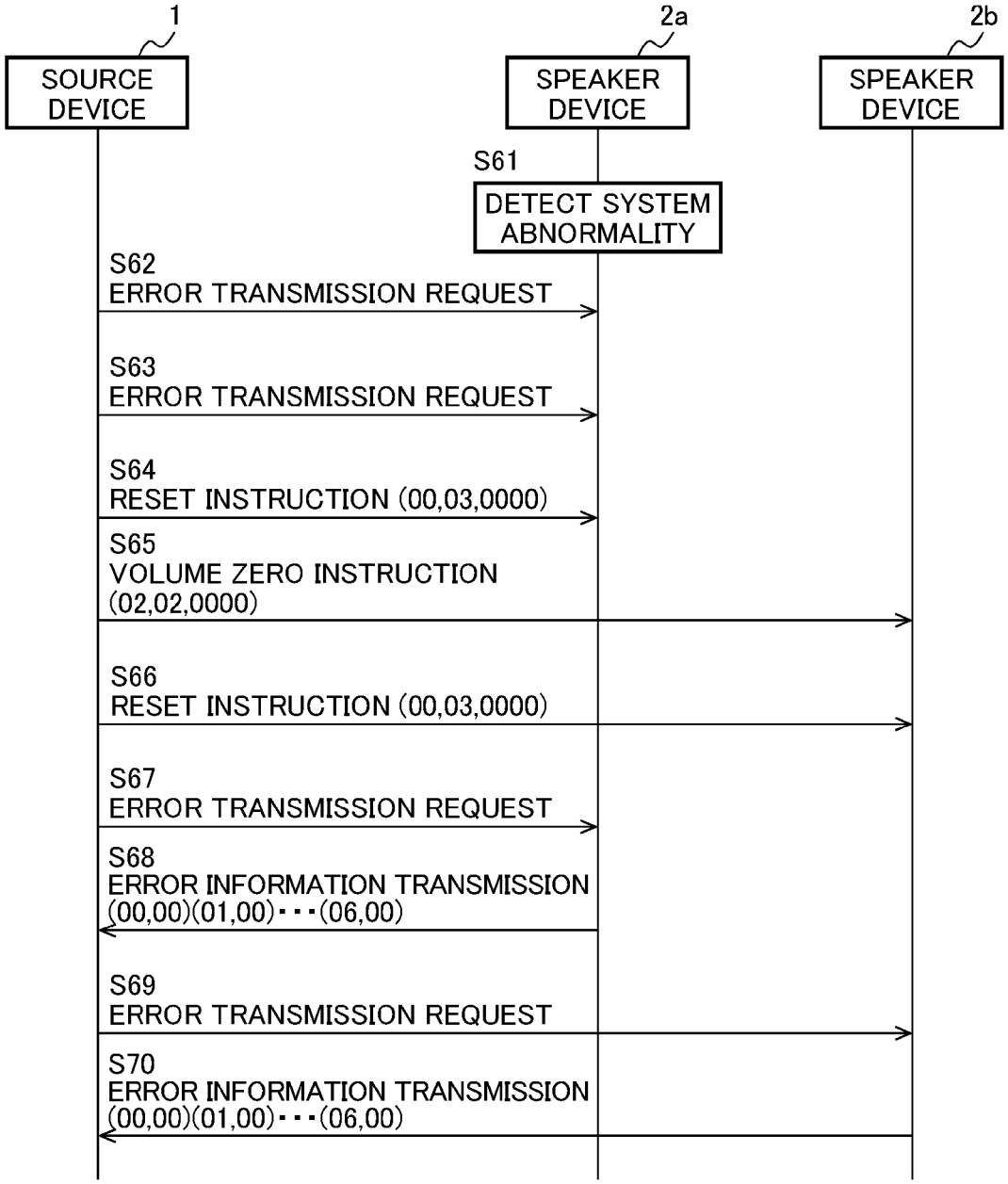
FIG. 13 is a sequence diagram for illustrating an example of a process procedure in a case where a system abnormality is detected in an audio wireless transmission system according to Sixth Embodiment of the invention.

In a case where the speaker device 2*a* detects the system abnormality (Step S61), there is no response, even when the error transmission request is transmitted to the speaker device 2*a* from the source device 1. When there is no response prescribed number of times, the source device 1 determines that the system abnormality has occurred in the speaker device 2*a* with no response, and transmits a reset request, that is, a reset instruction to the speaker device 2*a* (Step S64). In the example of FIG. 13, in Steps S62 and S63, in a case where there is no response even when the error transmission request is made two times, it is determined that the system abnormality has occurred.

The transmitted content in Step S64 is (00,03,0000). Herein, the first "00" means that the type of the device is the main control unit 20, the following "03" means that the command is a reset instruction, and the last "0000" means that "a command parameter is not necessary in this command".

The source device 1 stops the audio supply to all of the reception device in order to realize synchronization with the other reception device (that is, the speaker device 2*b*), and transmits a volume zero instruction and a reset instruction to the other reception device (Step S65 and S66).

The speaker devices 2*a* and 2*b* have a function of performing reset in another circuit containing the main control unit 20 by the wireless communication unit 21 with respect to the reset request. Accordingly, the speaker devices 2*a* and 2*b* receiving the reset instruction in Steps S 64 and S66 execute a reset by using this function. The reset means to block the analog power source and blocking the digital power source for restarting.

After that, the source device 1 transmits the error transmission request to all of the reception devices (Steps S67 and S69), and determines that the system is returned in a case where error information (00,00) . . . (06,00) indicating that the normal state is obtained is received as the status from all of the reception devices (Step S68 and S70), and the sound output is restarted.

As described above, the error relevant information contains at least one information item of a temperature measurement value, a voltage measurement value, a clock measurement value, and presence or absence of a clock operation, and accordingly, it is possible to avoid fatal errors. The presence or absence of a clock operation can be determined by making a request for a clock measurement value, but the determination of presence or absence may be simply requested. By making a request for information described above as the error relevant information, the source device 1 can obtain necessary specific information regarding the error.

(Others)

Hereinabove, the system according to the invention has been described, but a technology obtained by assuming WiSA may not employed for this system. For example, in WiSA, an integrated circuit (IC) chip which can receive an audio signal by radio is mounted on each of the speakers, but a plurality of signal processing units may be provided on one speaker device.

The source device or parts other than the speaker unit of the speaker device shown in FIG. 1 to FIG. 4 can be, for example, realized by hardware of a microprocessor (or digital signal processor: DSP), a memory, a bus, an interface, or a peripheral device such as a remote controller, and software capable of being executed on the hardware. Some parts of the hardware can be mounted as an integrated circuit/IC chip set, and in this case, the software may be stored in this memory. All of constituent elements of the invention may be configured with hardware, and even in that case, some parts of the hardware can be mounted as an integrated circuit/IC chip set, in the same manner as described above.

The objects of the invention are also achieved by supplying a recording medium in which program codes of software for realizing the functions of various configuration examples described above are recorded, to a source device or a reception device and executing the program codes by using a microprocessor or a DSP in each device. In this case, the program codes of the software realize the functions of various configuration examples described above, and the invention can be constituted by executing the program codes or by reading out and executing the codes by a control side, in a case of a recording medium (an external recording medium or an internal recording medium) in which program codes are recorded. As the external recording medium, various media such as an optical disc such as a CD-ROM or a DVD-ROM or a non-volatile semiconductor memory such as a memory card are used, for example. As the internal recording medium, various media such as a hard disk or a semiconductor memory are used. The program codes can be executed by downloading from the Internet or can be executed by receiving from broadcast waves.

Hereinabove, the audio wireless transmission system according to the invention has been described, but as the procedure of the processes has been described, the invention can also be applied as an embodiment of an audio wireless transmission method of an audio wireless transmission system including a plurality of speaker devices, and a source device which transmits an audio signal to the plurality of speaker devices by using wireless communication. Application examples and effects other than those shown hereinafter are in the same manner as described for the audio wireless transmission system and therefore the description thereof will be omitted.

An audio wireless transmission method according to one embodiment of the invention includes: a detection step of detecting an error relating to sound output by an error detection unit of the speaker device; a step of transmitting error information which is information of the error detected in the detection step to a source device by the speaker device; and a step of transmitting an operation request corresponding to the error information to a speaker device other than the speaker device which has transmitted the error information, by using wireless communication, by the source device.

An audio wireless transmission method according to another embodiment of the invention includes: a conversion step of converting an audio signal received from a source device by using wireless communication from a digital signal into an analog signal by a D/A converter of a speaker device; an amplification step of amplifying the analog signal output from the D/A converter by an amplification unit of the speaker device; an output step of outputting a sound of the analog signal output from the amplification unit by a speaker unit of the speaker device; an error detection step of executing a detection process of an error of the D/A converter and/or the amplification unit by an error detection unit of the speaker device; a step of transmitting error information to the source device by using wireless communication by a transmission unit of the speaker device, in a case where an error is detected in the error detection step; and a step of transmitting an operation request corresponding to the error information to a speaker device other than the speaker device which has transmitted the error information by using wireless communication by a transmission unit of the source device, in a case where a reception unit of the source device receives the error information.

In other words, the program codes are programs for causing a computer on the source device side and a computer of the speaker device side to execute the audio wireless transmission method according to one embodiment or another embodiment of the invention. Application examples and effects other than those shown hereinafter are in the same manner as described for the audio wireless transmission system and therefore the description thereof will be omitted.

A program causing a computer on a speaker device side to execute an audio wireless transmission method according to one embodiment of the invention includes a reception side program causing the computer to execute: a detection step of detecting an error relating to sound output; a step of transmitting error information which is information of the error detected in the detection step to a source device; and a step of receiving an operation request corresponding to the error information which is transmitted by the source device which has received the error information by using wireless communication from another speaker device capable of transmitting the error information by using wireless communication, by using wireless communication. The program described above includes a reception side program causing a computer on a source device side to execute a step of transmitting an operation request corresponding to the error information to a speaker device other than the speaker device which has transmitted the error information by using wireless communication.

A program causing a computer on a speaker device side to execute an audio wireless transmission method according to another embodiment of the invention includes a reception side program causing the computer to execute: a conversion step of converting an audio signal received from a source device by using wireless communication from a digital signal into an analog signal by instructing a D/A converter; an amplification step of amplifying the analog signal output from the D/A converter by instructing an amplification unit; an output step of outputting a sound of the analog signal output from the amplification unit; an error detection step of executing a detection process of an error of the D/A converter and/or the amplification unit; a step of transmitting error information to the source device by using wireless communication, in a case where an error is detected in the error detection step. The program described above includes a reception side program causing a computer on a source device side to execute a step of transmitting an operation request corresponding to the error information to a speaker device other than the speaker device which has transmitted the error information by using wireless communication, in a case where the error information is received.

As describe above, there is provided an audio wireless transmission system according to one embodiment of the invention including: a plurality of speaker devices; and a source device which transmits an audio signal to the plurality of speaker devices by using wireless communication, in which the speaker device includes an error detection unit which detects an error regarding sound output and transmits error information which is information regarding error detected by the error detection unit to the source device by using wireless communication, and the source device transmits an operation request corresponding the error information by using wireless communication to speaker devices other than the speaker device which has transmitted the error information. Therefore, in a case where an error has occurred in a certain speaker device, it is possible to rapidly reduce a possibility of occurrence of the same error in another speaker device by the control from the source device side, and it is possible to obtain the effect of preventing the same error from occurring in advance, in some cases.

The speaker device includes an analog power source unit which supplies electric power to an analog circuit, a digital power source unit which supplies electric power to a digital circuit, a wireless reception unit which receives the audio signal, a control unit, a D/A converter which converts the audio signal received by the wireless reception unit into an analog signal from the digital signal, an amplification unit which amplifies the analog signal output from the D/A converter, and a speaker unit which outputs sound of the analog signal output from the amplification unit. Therefore, it is possible to obtain the effects described above in the audio wireless transmission system including the speaker device having such a configuration.

Herein, the error detection unit may execute a detection process of errors with respect to at least one unit of the analog power source unit, the digital power source unit, the wireless reception unit, the control unit, the D/A converter, the amplification unit, and the speaker unit. Therefore, it is possible to obtain the effects described above in the audio wireless transmission system including the speaker device having such a configuration.

It is preferable that the amplification unit and the speaker unit are provided in the same housing as or a separate housing from the wireless reception unit. Therefore, it is possible to cope with various arrangement relations.

The error information may include information indicating at least one of an overcurrent warning, a voltage drop warning, an overtemperature warning, a voltage abnormality warning, a current offset warning, a clock abnormality warning, a clock stop warning, and a system abnormality warning. Therefore, the source device can receive a warning of a monitoring target as error information.

It is preferable that the source device instructs the speaker device which has transmitted the error information or some or all of the plurality of speaker devices to measure and detect error relevant information which is information related to an error indicated by the received error information. Therefore, the source device can obtain specific information regarding an error.

The error relevant information may include at least one information of a temperature measurement value, a voltage measurement value, a clock measurement value, and presence or absence of a clock operation. Therefore, the source device can obtain necessary specific information regarding an error and a fatal error can be avoided.

It is preferable that the source device further includes a display unit which displays information indicating occurrence of an error, in a case where the error information is received. Therefore, not only a process of rapidly stopping the operation of the entire system on the reception side can be performed due to the error occurred in one speaker device, but it is also possible to immediately inform a user of the content of the error.

There is provided an audio wireless transmission system according to another embodiment of the invention including: a plurality of speaker devices; and a source device which transmits an audio signal to the plurality of speaker devices by using wireless communication, in which the speaker device includes a D/A converter which converts the audio signal received from the source device by using wireless communication from a digital signal into an analog signal, an amplification unit which amplifies the analog signal output from the D/A converter, a speaker unit which outputs sound of the analog signal output from the amplification unit, and an error detection unit which executes a detection process of an error of the D/A converter and/or the amplification unit, and transmits error information which is information regarding error detected by the error detection unit to the source device by using wireless communication, and the source device transmits an operation request corresponding to the error information by using wireless communication to speaker devices other than the speaker device which has transmitted the error information, in a case where the error information is received. Therefore, in a case where an error has occurred in a certain speaker device, it is possible to rapidly reduce a possibility of occurrence of the same error in another speaker device by the control from the source device side, and it is possible to prevent the same error from occurring in advance, in some cases.

The source device may include a table in which operation requests to be transmitted in accordance with the error information are described. Therefore, it is possible to immediately transmit an operation request signal to the other speaker device at the time of error occurrence.

The source device may transmit an operation stop request to a speaker device other than the speaker device which has transmitted the error information by using wireless communication, in a case where the error information is received. Therefore, it is possible to further avoid error occurrence in the other speaker device.

The source device may further include a display unit which displays information indicating that an error has occurred, in a case where the error information is received. Therefore, not only a process of rapidly stopping the operation of the entire system on the reception side can be performed due to the error occurred in one speaker device, but it is also possible to immediately inform a user of the content of the error.

The speaker device may include a control unit which controls the D/A converter and the amplification unit, and the error detection unit may perform a detection process of an error of the control unit, in addition to the detection process of an error of the D/A converter and/or the amplification unit. Therefore, not only an error of the D/A converter or the amplification unit, but also an error of the control unit which controls the D/A converter or the amplification unit can also be coped with.

The speaker device may further include a signal processing unit which performs a prescribed signal process with respect to an audio signal received from the source device by using wireless communication, the D/A converter may convert the audio signal processed by the signal processing unit from a digital signal to an analog signal, and the error detection unit may perform a detection process of an error of the signal processing unit, in addition to the detection process of an error of the D/A converter and/or the amplification unit. Therefore, not only an error of the D/A converter or the amplification unit, but also an error of the signal processing unit can also be coped with.

One or a plurality of D/A converters are provided in the speaker device. Therefore, it is possible to cope with various arrangement relations.

It is preferable that the speaker device is provided in the same housing as that of the D/A converters. Therefore, the system is configured to output aligned sounds so that the speaker unit and the D/A converters or the amplification units are not damaged, in a case where the system is distributed as a product, and therefore, it is also possible to output high-quality sounds as an audio wireless transmission system.

Alternatively, the speaker device may be provided in a hosing different from that of the D/A converter and may be connected to the D/A converter in a wired manner. Therefore, it is possible to enjoy the effects of the audio wireless transmission system of the embodiment by using the audio wireless transmission system, by only connecting a speaker owned by a user to the reception devices.

As will be described below, the invention can also be applied as an embodiment as the speaker device or an embodiment as the source device of the audio wireless transmission system. Application examples other than those shown hereinafter are in the same manner as described for the audio wireless transmission system and therefore the description thereof will be omitted.

There is provided a speaker device according to one embodiment of the invention including: a wireless reception unit which receives an audio signal transmitted from a source device by using wireless communication; and an error detection unit which detects an error regarding sound output, in which error information which is information regarding error detected by the error detection unit is transmitted to the source device by using wireless communication, and an operation request corresponding to the error information which is transmitted by the source device which has received the error information by using wireless communication from another speaker device capable of transmitting the error information by using wireless communication, is received by using wireless communication. Therefore, in a case where an error has occurred in a certain speaker device, it is possible to rapidly reduce a possibility of occurrence of the same error in another speaker device by the control from the source device side, and it is possible to prevent the same error from occurring in advance, in some cases.

There is provided a speaker device according to another embodiment of the invention which receives an audio signal transmitted from a source device by using wireless communication, the speaker device including: a D/A converter which converts the audio signal received from the source device by using wireless communication from a digital signal into an analog signal, an amplification unit which amplifies the analog signal output from the D/A converter, a speaker unit which outputs sound of the analog signal output from the amplification unit, and an error detection unit which executes a detection process of an error of the D/A converter and/or the amplification unit, and transmits error information which is information regarding error detected by the error detection unit to the source device by using wireless communication, and an operation request corresponding to the error information which is transmitted by the source device which has received the error information by using wireless communication from another speaker device capable of transmitting the error information by using wireless communication, is received by using wireless communication. Therefore, in a case where an error has occurred in a certain speaker device, it is possible to rapidly reduce a possibility of occurrence of the same error in another speaker device by the control from the source device side, and it is possible to prevent the same error from occurring in advance, in some cases.

There is provided a source device according to one embodiment of the invention which transmits an audio signal to a plurality speaker devices by using wireless communication, in which the speaker device includes an error detection unit which detects an error regarding sound output and transmits error information which is information regarding error detected by the error detection unit to the source device by using wireless communication, and the source device transmits an operation request corresponding to the error information by using wireless communication to speaker devices other than the speaker device which has transmitted the error information. Therefore, in a case where an error has occurred in a certain speaker device, it is possible to rapidly reduce a possibility of occurrence of the same error in another speaker device by the control from the source device side, and it is possible to prevent the same error from occurring in advance, in some cases.

There is provided a source device according to another embodiment of the invention which transmits an audio signal to a plurality of speaker devices by using wireless communication, in which the speaker device includes a D/A converter which converts the audio signal received from the source device by using wireless communication from a digital signal into an analog signal, an amplification unit which amplifies the analog signal output from the D/A converter, a speaker unit which outputs sound of the analog signal output from the amplification unit, and an error detection unit which executes a detection process of an error of the D/A converter and/or the amplification unit, and error information which is information regarding error detected by the error detection unit to the source device by using wireless communication, and the source device transmits an operation request corresponding to the error information by using wireless communication to speaker devices other than the speaker device which has transmitted the error information, in a case where the error information transmitted to the source device by using wireless communication is received. Therefore, in a case where an error has occurred in a certain speaker device, it is possible to rapidly reduce a possibility of occurrence of the same error in another speaker device by the control from the source device side, and it is possible to prevent the same error from occurring in advance, in some cases.

REFERENCE SIGNS LIST

1 SOURCE DEVICE
2*a*, 2*b* SPEAKER DEVICE
10 MAIN CONTROL UNIT OF SOURCE DEVICE
11 HDMI PROCESSING UNIT
12 MEMORY OF SOURCE DEVICE
12*a* TABLE
13 SIGNAL PROCESSING UNIT OF SOURCE DEVICE
14 DISPLAY UNIT
15 WIRELESS COMMUNICATION UNIT OF SOURCE DEVICE
16 OPERATION UNIT
20 MAIN CONTROL UNIT
21 WIRELESS COMMUNICATION UNIT
22 MEMORY
24 SIGNAL PROCESSING UNIT
24*a* VOLUME ADJUSTMENT UNIT
25*t*, 25*m*, 25*w* DAC
26*t*, 26*m*, 26*w* AMPLIFICATION UNIT
27*t*, 27*m*, 27*w* SPEAKER UNIT

The invention claimed is:

1. An audio wireless transmission system comprising:
a plurality of speaker devices; and
a source device which transmits an audio signal to the plurality of speaker devices by using wireless communication, wherein
the speaker device includes error detection circuitry that detects an error regarding sound output and transmits error information which is information regarding error detected by the error detection circuitry to the source device by using wireless communication, and
the source device transmits an operation stop request or a mute request as an operation request corresponding to the error information by using wireless communication to speaker devices other than the speaker device that has transmitted the error information.

2. The audio wireless transmission system according to claim 1, wherein the speaker device includes an analog power source that supplies electric power to an analog circuit, a digital power source that supplies electric power to a digital circuit, wireless reception circuitry that receives the audio signal, control circuitry, a D/A converter that converts the audio signal received by the wireless reception circuitry into an analog signal from the digital signal, amplification circuitry that amplifies the analog signal output from the D/A converter, and a speaker that outputs sound of the analog signal output from the amplification circuitry.

3. The audio wireless transmission system according to claim 2, wherein the error detection circuitry executes a detection process of errors with respect to at least one of the analog power source, the digital power source, the wireless reception circuitry, the control circuitry, the D/A converter, the amplification circuitry, and the speaker.

4. The audio wireless transmission system according to claim 2, wherein the amplification circuitry and the speaker are in a same housing as or a separate housing from the wireless reception circuitry.

5. The audio wireless transmission system according to claim 1, wherein the error information includes information indicating at least one of an overcurrent warning, a voltage drop warning, an overtemperature warning, a voltage abnormality warning, a current offset warning, a clock abnormality warning, a clock stop warning, and a system abnormality warning.

6. The audio wireless transmission system according to claim 1, wherein the source device instructs the speaker device which has transmitted the error information or some or all of the plurality of speaker devices to measure and detect error relevant information which is information related to an error indicated by the received error information.

7. The audio wireless transmission system according to claim 6, wherein the error relevant information includes at least one of information of a temperature measurement value, a voltage measurement value, a clock measurement value, and presence or absence of a clock operation.

8. The audio wireless transmission system according to claim 1, wherein the source device further includes a display that displays information indicating the occurrence of an error, in a case where the error information is received.

9. A speaker device comprising:

wireless reception circuitry that receives an audio signal transmitted from a source device by using wireless communication, wherein the speaker device includes error detection circuitry that detects an error regarding sound output and transmits error information which is information regarding an error detected by the error detection circuitry to the source device by using wireless communication, and the speaker device receives an operation stop request or a mute request as an operation request corresponding to the error information which is transmitted by using wireless communication by the source device that has received the error information from another speaker device capable of transmitting the error information by using wireless communication, by using wireless communication.

10. A source device that transmits an audio signal to a plurality of speaker devices by using wireless communication, wherein the source device receives error information that is information regarding an error detected by error detection circuitry of each of the plurality of speaker devices by using wireless communication, and the source device transmits an operation stop request or a mute request as an operation request corresponding to the error information by using wireless communication to speaker devices of the plurality of speaker devices other than one of the plurality of speaker devices that has transmitted the error information.

* * * * *